US008346145B2

(12) United States Patent
Nanjo et al.

(10) Patent No.: US 8,346,145 B2
(45) **Date of Patent: *Jan. 1, 2013**

(54) FIXING UNIT AND IMAGE FORMING APPARATUS COMPRISING FIXING UNIT

(75) Inventors: Yuzuru Nanjo, Osaka (JP); Tamami Asari, Osaka (JP); Syoukou Gon, Osaka (JP)

(73) Assignee: Kyocera Mita Corporation (JP)

( * ) Notice: Subject to any disclaimer, the term of this patent is extended or adjusted under 35 U.S.C. 154(b) by 525 days.

This patent is subject to a terminal disclaimer.

(21) Appl. No.: 12/546,182

(22) Filed: Aug. 24, 2009

(65) Prior Publication Data

US 2010/0046996 A1 Feb. 25, 2010

(30) Foreign Application Priority Data

Aug. 25, 2008 (JP) ..... 2008-215215

(51) Int. Cl.
*G03G 15/20* (2006.01)

(52) U.S. Cl. ..... 399/329; 399/330; 399/67

(58) Field of Classification Search ..... 399/320, 399/330, 336

See application file for complete search history.

(56) References Cited

U.S. PATENT DOCUMENTS

RE36,962 E 11/2000 Higashi et al.
2002/0186991 A1 12/2002 Watanabe et al.
2006/0029411 A1* 2/2006 Ishii et al. ..... 399/67
2007/0014599 A1 1/2007 Yasuda et al.
2007/0014601 A1* 1/2007 Yasuda et al. ..... 399/329
2008/0219721 A1* 9/2008 Ito et al. ..... 399/320

FOREIGN PATENT DOCUMENTS

JP 2001-125407 5/2001
JP 2003-107941 4/2003

* cited by examiner

*Primary Examiner* — Walter L Lindsay, Jr.

*Assistant Examiner* — Roy Y Yi

(74) *Attorney, Agent, or Firm* — Gerald E. Hespos; Michael J. Porco

(57) ABSTRACT

A fixing unit for fixing a toner image onto paper has a member to be heated and a pressurizing member configured to press against the member to be heated and fix the toner image to the paper. At least one coil surface is disposed along one surface of the member to be heated and includes a coil to generate a magnetic field for inductively heating the member. A magnetism shielding member is disposed near the coil surface. A switch includes a first member to allow passage of the magnetic field and a second member to prevent passage of the magnetic field. The amount of heat for the member when the switch is in a first position where the second member is close to the magnetism shielding member is smaller than when the switch is in a second position where the second member is distanced from the magnetism shielding member.

21 Claims, 19 Drawing Sheets

58
90
90
60
60
90
90
90

FIXING UNIT AND IMAGE FORMING APPARATUS COMPRISING FIXING UNIT

BACKGROUND OF THE INVENTION

1. Field of the Invention

The present invention relates to a fixing unit which heats and melts unfixed toner, thereby fixing the toner to paper, while paper bearing a toner image is passed between a pair of heated rollers or into a nip between a heated belt and a roller, and to an image forming apparatus which comprises this fixing unit.

2. Description of the Related Art

Recently reduction of time and energy for warming up the fixing unit is required for apparatuses which fix toner using thermal energy. In respect of these requirements, a belt-type of the fixing units, which allows a decrease in the heat capacity, has been developed (see, for example, Japanese Patent Application Publication No. H6-318001). Furthermore, in recent years, an electromagnetic induction heating method (IH) which is capable of fast and highly efficient heating has been applied to the fixing unit. In order to save energy for fixing color images, the belt type of the fixing unit with electromagnetic induction heating system has been developed and image forming apparatuses including such fixing unit has been launched into the market. The belt type of the fixing unit with electromagnetic induction heating system simplifies coil design and layout, as well as facilitating to cool the coil. An electromagnetic induction system disposed on the outer side of the belt of the fixing unit (a so-called "external wrap IH") directly heats the belt.

The fixing unit disclosed in Japanese Patent Application Publication No. 2003-107941 and Japanese Patent Publication No. 3527442 includes an external wrap IH system and does not overheat a portion of the belt with which the paper does not contact during its passage.

The fixing unit disclosed in Japanese Patent Application Publication No. 2003-107941 comprises a plurality of magnetic members which are arranged in the width direction of the paper passing through the fixing unit. At least one of the plurality of magnetic members is distanced from or moved toward an excitation coil in accordance with the width dimension of the paper passing through the fixing unit. When a magnetic member located in a position at which the paper does not pass is distanced from the excitation coil, the heating efficiency falls. Consequently, the amount of heat generated in a region where a distanced magnetic member is located is smaller than the amount of heat generated in a region where other magnetic members are located.

The fixing unit disclosed by the Japanese Patent Publication No. 3527442 comprises a conductive member which can be moved inside and outside the effective range of a magnetic field. Firstly, a conductive member is positioned outside the effective range of the magnetic field and a heating roller is heated with electromagnetic induction. If the temperature of the heating roller approaches the Curie temperature, then the conductive member moves inside the effective range of the magnetic field. A magnetic flux leaks from the heating roller to the outside of the region where the narrowest paper among the several papers which run in the image forming apparatus passes, thereby preventing excessive temperature rise. A larger conductive member is more capable of suppressing excessive temperature rise, but is not better at completely withdrawing from the effective range of the magnetic field. A small portion of the large conductive member remaining in the effective range of the magnetic field affects the magnetic field. Consequently, enlargement in surface area of the conductive member may provide undesirable effects while it may contribute to suppressing excessive temperature rise.

SUMMARY OF THE INVENTION

The object of the present invention is to provide technology capable of effectively suppressing excessive temperature rise outside the paper passage region without excessively increasing the surface area of members configured to shield magnetism so that the members for shielding magnetism in a retracted position do not affect the magnetic field.

One aspect of the present invention to achieve the aforementioned object provides a fixing unit comprising: a member to be heated; a pressurizing member configured to press against the member to be heated and fix the toner image to the paper; at least one coil surface disposed along one surface of the member to be heated and including a coil configured to generate a magnetic field for inductively heating the member; at least one magnetism shielding member disposed in the vicinity of the at least one coil surface; and a switching member including a first member configured to allow a passage of a magnetic flux of the magnetic field and a second member configured to prevents the passage of the magnetic flux of the magnetic field, wherein the amount of heat for the member when the switching member is situated in a first position where the second member is close to the at least one magnetism shielding member is smaller than when the switching member is situated in a second position where the second member is distanced from the at least one magnetism shielding member.

Another aspect of the present invention provides the image forming apparatus including the aforementioned fixing apparatus.

DETAILED DESCRIPTION OF THE PREFERRED EMBODIMENTS

Below, an embodiment of the present invention is described in detail with reference to the drawings.

Figure 1:
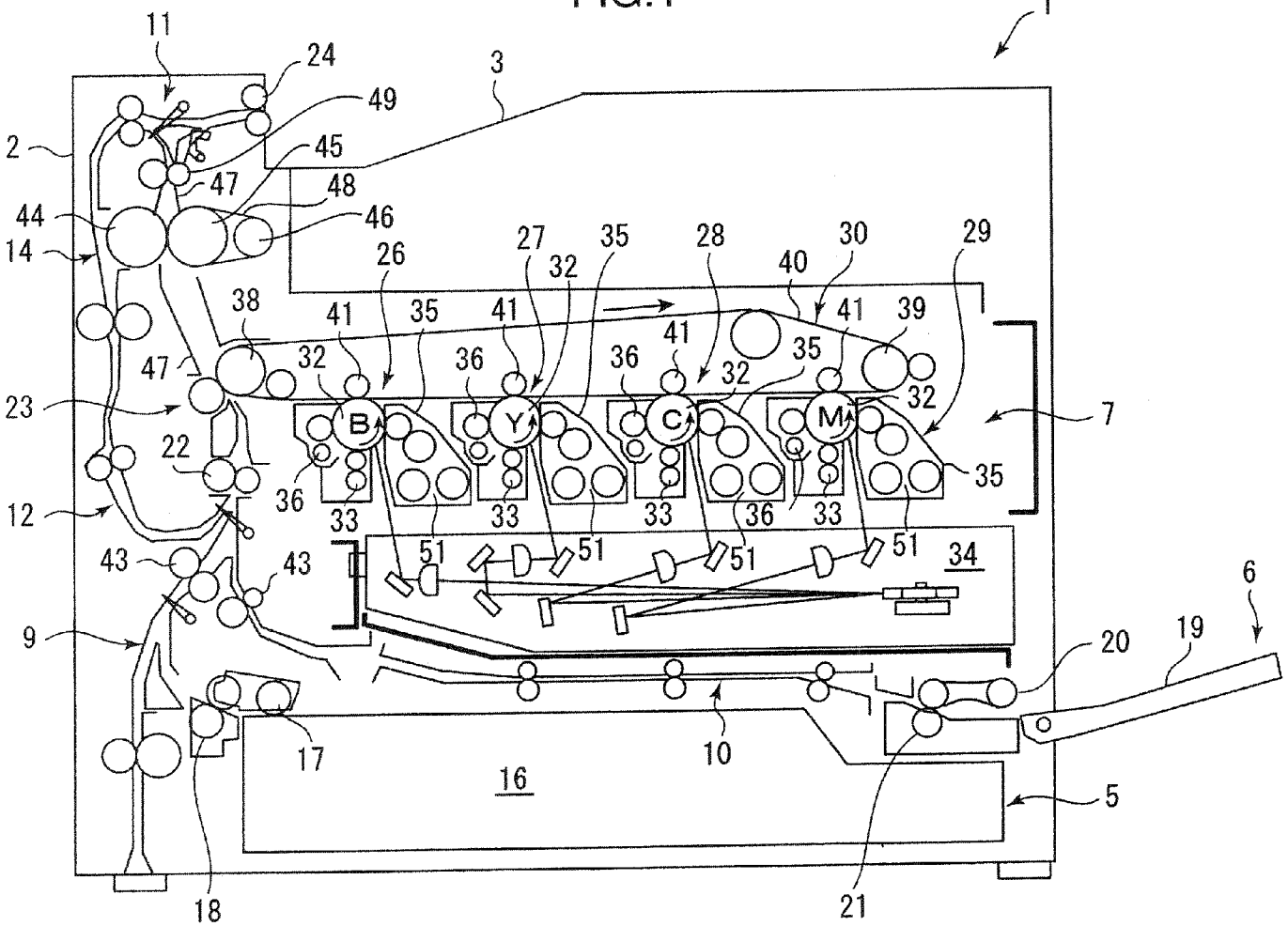
FIG. 1 is a schematic drawing showing the composition of an image forming apparatus according to one embodiment.

FIG. 1 is a schematic drawing showing the composition of an image forming apparatus 1 according to one embodiment. The image forming apparatus 1 may be a printer, a copying machine, a facsimile apparatus, a composite machine including the functions of these machines or another apparatus which carries out printing by transferring a toner image to the surface of a print medium such as printing paper, on the basis of image information input from an external source.

The image forming apparatus 1 shown in FIG. 1 may be a tandem type color printer. This image forming apparatus 1 comprises a square box-shaped main body 2 in which a color image is formed (printed) onto the paper. A paper discharge unit (discharge tray) 3 is provided on the upper surface of the main body 2. The paper discharge unit 3 is configured to discharge paper onto which a color image has been printed.

The main body 2 comprises a supply cassette 5 configured to supply paper, a stack tray 6 for manual paper feed above the paper supply cassette 5, and an image forming unit 7 above the stack tray 6. The image forming unit 7 forms an image on paper on the basis of image data such as text characters, a picture, or the like. The image data may be sent from an external source to the image forming apparatus 1.

A first conveyance path 9 is disposed in the left-hand portion of the main body 2 shown in FIG. 1. Paper fed out from the paper supply cassette 5 passes through the first conveyance path 9, and then arrives at the image forming unit 7. The second conveyance path 10 is disposed above the paper supply cassette 5. Paper fed out from the stack tray 6 passes through the second conveyance path 10 so as to move from left to right in the main body 2, and then arrives at the image forming unit 7. A fixing unit 14 and a third conveyance path 11 are provided in the upper left-hand portion of the interior of the main body 2. The fixing unit 14 is configured to carry out a fixing process to the paper on which the image forming unit 7 has formed an image. The paper subjected to the fixing process passes through the third conveyance path 11 to the paper discharge unit 3.

The paper supply cassette 5 may be configured to be withdrawable to the outside of the main body 2 so as to replenish the paper therein (to the right-hand side in FIG. 1, for example). The paper supply cassette 5 comprises an accommodating unit 16 which is capable of selectively accommodating at least two types of paper with different sizes in paper supply direction. A paper feed roller 17 and a paper handling roller 18 feed paper in the accommodating unit 16 one by one to the first conveyance path 9.

The stack tray 6 is configured to rotate upwardly and downwardly between a closed position where the tray 6 lies down the outer surface of the main body 6 and an open position (as shown in FIG. 1) where the tray projects from the outer surface of the apparatus main body 2. The stack tray 6 includes a manual feed section 19 on which a user may put paper one by one or a stack of a plurality of sheets for manual feed. A pickup roller 20 and a paper handling roller 21 feed paper on the manual feed section 19 to the second conveyance path 10 one by one.

The first conveyance path 9 and the second conveyance path 10 converge before a resist roller 22. The paper arriving at the resist roller 22 is halted there temporarily, and then after adjustment of skew and timing, is sent toward a secondary transfer unit 23. When the paper is supplied to the secondary transfer unit 23, the secondary transfer unit 23 transfers a full-color toner image on the intermediate transfer belt 40 to the paper (secondary transfer). After the secondary transfer, the paper is supplied to the fixing unit 14 configured to fix the toner image onto the paper. After the toner image is fixed on the paper, optionally, the paper may be supplied to a fourth conveyance path 12 and inverted, and then the paper may be subjected to the secondary transfer, so that the secondary transfer unit transfers a full-color toner image onto the other surface of the paper. After the fixing unit 14 fixes the new toner image, the discharge roller 24 discharges the paper to the paper discharge unit 3 via the third conveyance path 11.

The image forming unit 7 comprises four image forming units 26 to 29 which form respective toner images of black (B), yellow (Y), cyan (C), magenta (M). Moreover, the image forming unit 7 comprises an intermediate transfer unit 30 which combines and carries the toner images of the respective colors formed by these image forming units 26 to 29.

Each of the image forming units 26 to 29 comprises a photosensitive drum 32, a charging unit 33 which is provided in parallel with the circumferential surface of the photosensitive drum 32, a laser scanning unit 34 configured to irradiate a laser beam on a specified position of the circumferential surface of the photosensitive drum 32 in the downstream of the charging unit 33. Each of the image forming units 26 to 29 further comprises a developing unit 35 which is disposed at the downstream of the irradiation position of the laser beam from the laser scanning unit 34, so as to face the circumferential surface of the photosensitive drum 32. Each of the image forming units 26 to 29 yet further comprises a cleaning unit 36 facing the circumferential surface of the photosensitive drum 32. The cleaning unit 36 is disposed at the downstream of the developing unit 35.

The photosensitive drums 32 of the respective image forming units 26 to 29 shown in FIG. 1 are rotated in the counter-clockwise direction by a drive motor (not illustrated). Black toner, yellow toner, cyan toner and magenta toner are accommodated respectively inside toner boxes 51 of the developing units 35 of the image forming units 26 to 29.

The intermediate transfer unit 30 comprises: a rear roller (drive roller) 38 which is disposed in the vicinity of the image forming unit 26; a front roller (idle roller) 39 which is disposed in the vicinity of the image forming unit 29; an intermediate transfer belt 40 extending between the rear roller 38 and the front roller 39; and four transfer rollers 41 configured to press the photosensitive drums 32 via the intermediate transfer belt 40. These transfer rollers 41 are positioned at the downstream of the developing unit 35 in terms of the rotational direction of the photosensitive drums 32 in the respective image forming units 26 to 29.

The transfer rollers 41 of the image forming units 26 to 29 transfers the toner images of the respective colors onto the intermediate transfer belt 40 in a mutually superimposed fashion, respectively, thereby ultimately forming a full-color toner image.

The first conveyance path 9 extends toward the intermediate transfer unit 30. The paper fed from the paper supply cassette 5 goes through the first conveyance path 9 and arrives at the intermediate transfer unit 30. The first conveyance path 9 comprises a plurality of conveyance rollers 43 which are disposed at a prescribed position inside the main body 2, and a resist roller 22 which is provided before the intermediate transfer unit 30 and configured to synchronize the timing between the image forming operation in the image forming unit 7 and the paper supply operation.

The toner image is not still fixed just after its transfer from the image forming unit 7 onto the paper. The fixing unit 14 applies heat and pressure to the paper bearing the unfixed image so as to fix the toner image on the paper. The fixing unit 14 may comprise a pair of rollers including a heated pressurization roller 44 and a fixing roller 45, for example. The pressurization roller 44 may include, for instance, a metal core member and an elastic surface layer (for example, silicone rubber). The fixing roller 45 may include a metal core member, an elastic surface layer (for example, silicone sponge) and a separating layer (for example, PFA). Furthermore, a heating roller 46 is provided adjacent to the fixing roller 45. A heated belt 48 is wound around this heating roller 46 and the fixing roller 45. The detailed structure of the fixing unit 14 is described further below.

Conveyance paths 47 are provided respectively on the upstream side and the downstream side of the fixing unit 14 in terms of the conveyance direction of the paper.

The paper passing through the intermediate transfer unit 30 is introduced into the nip between the pressurization roller 44 and the fixing roller 45 via the upstream-side conveyance path 47. The paper passing between the pressurization roller 44 and the fixing roller 45 is sent to the third conveyance path 11 via the downstream-side conveyance path 47.

Third conveyance path 11 includes a conveyance roller 49 configured to convey the paper subjected to the fixing process in the fixing unit 14 to the paper conveyance unit 3. The conveyance roller 49 is disposed at an appropriate position in the third conveyance path 11. Furthermore, a discharge roller 24 is provided at the outlet of the third conveyance path 11.

Details of Fixing Unit

A First Embodiment

Next, the details of the fixing unit 14 (the first embodiment) which is incorporated into the image forming apparatus 1 according to the present embodiment will be described. Further fixing units 14 (the second to fifth embodiments) are described below with reference to FIG. 16 to FIG. 19. The term "paper passage width" used in the description given below means the width dimension of the paper passing inside the image forming apparatus 1 described above, and in general it means the dimension of the paper in the direction perpendicular to the paper conveyance direction inside the image forming apparatus 1. In general, the paper width is determined by industrial standards (ISO, JIS, DIN, and so on), but the present invention is not limited to these. Moreover, the term "greatest paper passage width" used in the following description means the greatest width dimension of the paper which the image forming apparatus 1 accepts. In the case of the image forming apparatus 1 described in relation to FIG. 1, this term means the greatest width of the paper which may be accommodated in the paper supply cassette 5 of the image forming apparatus 1 and which may be conveyed from the paper supply cassette 5, or the greatest width of the paper which is permitted for conveyance from the stack tray 6. Furthermore, the term "smallest paper passage width" used in the following description means the smallest width dimension of the paper which may pass through the image forming apparatus 1. In the case of the image forming apparatus 1 described in relation to FIG. 1, this term means the smallest width of the paper which may be conveyed from the paper supply cassette 5 of the image forming apparatus 1, or the smallest width of the paper which is permitted for conveyance from the stack tray 6.

Figure 2A:
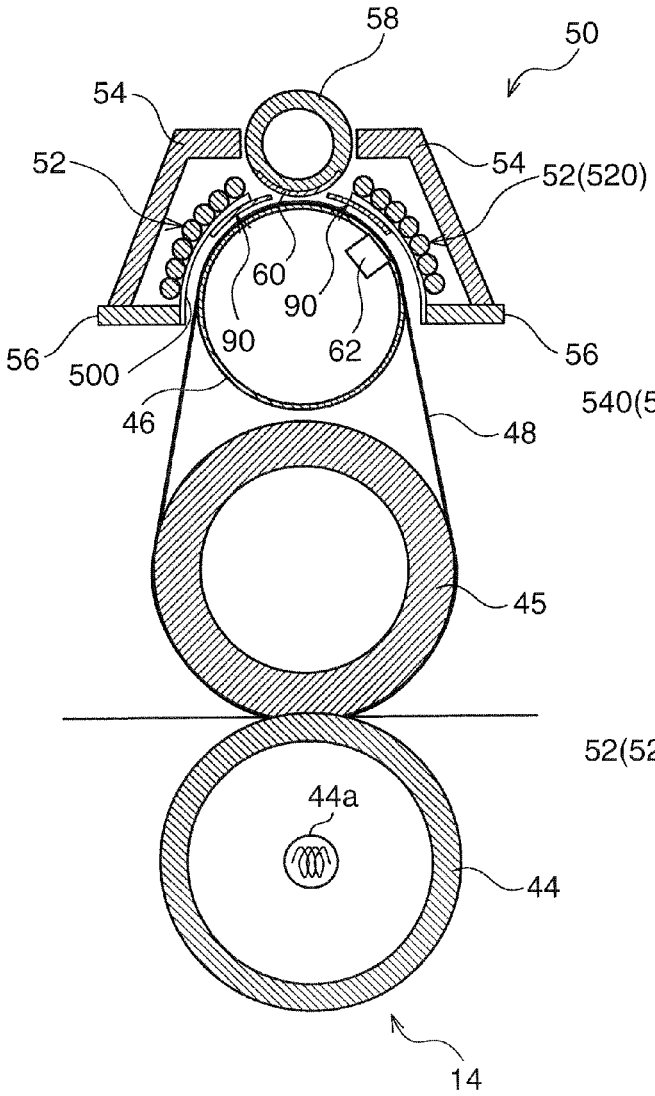
FIG. 2A is a vertical cross-sectional diagram showing a fixing unit according to a first embodiment.
Figure 2B:
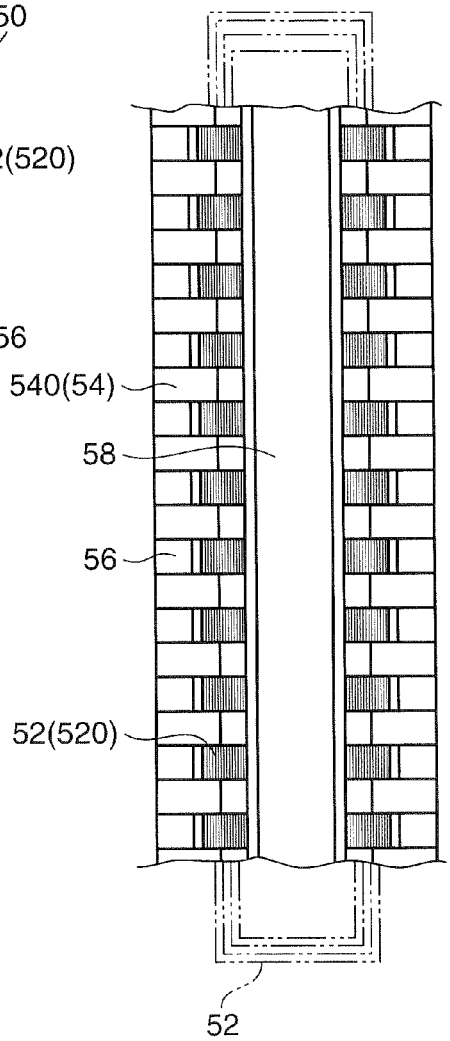
FIG. 2B is a vertical cross-sectional diagram showing a fixing unit according to the first embodiment.

FIGS. 2A and 2B exemplarily show the fixing unit 14 according to the first embodiment. FIG. 2A is a cross-sectional diagram showing the fixing unit 14 in FIG. 1 after rotation through approximately 90° in the counter-clockwise direction. Consequently, it should be understood that the paper conveyance direction indicated in FIGS. 2A and 2B is from right to left, although the paper conveyance direction shown in FIG. 1 is from below toward the right-hand side. If the fixing unit 14 is used in a large-scale main body 2, which a composite machine may include for example, the direction of the fixing unit 14 shown in FIGS. 2A and 2B may be applicable to the main body 2. Furthermore, FIG. 2B is a plan diagram of the fixing unit 14 shown in FIG. 2A.

As stated above, the fixing unit 14 comprises a pressurization roller 44, a fixing roller 45, a heating roller 46 and a heating belt 48. Moreover, as described above, an elastic layer including a silicone sponge is formed on the surface of the fixing roller 45. A flat nip is formed between the heating belt 48 and the fixing roller 45.

The base material of the heating belt 48 may be made of a ferromagnetic material (for example, nickel). A thin elastic layer (for example, silicone rubber) may be formed on the surface of the heating belt 48. The surface of the heating belt 48 may be covered with a separating layer (for example, PFA). If it is not required for the heating belt 48 to have a heat generating function, then the heating belt 48 may be a resin belt made of PI, or the like. The metal core of the heating roller 46 may be made of a magnetic metal (such as iron or stainless steel). The surface of the metal core of the heating roller 46 may be covered with a separating layer (for example, PFA).

The metallic core of the heating roller 44 may be made from an iron, aluminum, or the like, for example. A silicone rubber may be formed on this core material. A fluorine rubber layer may be formed on the surface of this silicone rubber layer. A halogen heater 44*a* may be provided inside the pressurization roller 44, for example.

The fixing unit 14 further comprises an IH coil unit 50 (not shown in FIG. 1) on the outer side of the heating roller 46 and the heating belt 48. The IH coil unit 50 comprises an induction heating coil 52, a pair of arch cores 54, a pair of side cores 56 and a center core 58.

(Coils)

In the first embodiment shown in FIGS. 2A and 2B, the induction heating coil 52 is disposed on an arc surface which follows the arc outer surface of the heating roller 46 and/or heating belt 48, so as to perform induction heating in the arc area of the heating roller 46 and the heating belt 48. A bobbin 500 made of resin, for example, may be disposed on the outer side of the heating roller 46 and the heating belt 48. The induction heating coil 52 is windingly disposed on the bobbin 500. As a result, the induction heating coil 52 is disposed in order on the arc surface of the bobbin 500 to form an arc coil surface 520. The induction heating coil 52 forms a loop above the heating roller 46 when observed in plan view. In the first embodiment shown in FIGS. 2A and 2B, the upper half portion of the heating roller 46 is substantially surrounded by the induction heating coil 52. Consequently, the coil surfaces 520 are formed on the left and right sides of the heating roller 46. The left and right coil surfaces 520 extend in the longitudinal direction of the heating roller 46. The bobbin 500 may be a semi-circular cylindrical along the outer surface of a heating roller 46. Furthermore, the material of the bobbin 500 may be desirably a heat-resistant resin (for example, PPS, PET, LCP). In order to avoid making the description unnecessarily difficult to understand, the bobbin 500 is omitted from the diagrams other than FIGS. 2A and 2B. Consequently, it should be understood that the induction heating coil 52 is wound around the bobbin 500 in the other fixing units 14 (the second to fifth embodiments) described in relation to FIG. 16 to FIG. 19 as well.

(Magnetic Core)

Referring to FIGS. 2A and 2B, the center core 58 is disposed in a central position. The pair of arch cores 54 and the pair of side cores 56 (left side core and right side core) are symmetrically disposed about the axis of the center core 58. The pair of arch cores 54 may be ferrite cores (magnetic cores) which are formed with an arched cross-section. The total length of the respective arch cores 54 may be greater than the winding region of the induction heating coil 52 (coil surface 520). The pair of side cores 56 may be ferrite cores (magnetic cores) which are formed as blocks. The side cores 56 are connected to one end of the respective arch cores 54 (the lower end in FIGS. 2A and 2B). These arch cores 54 and side cores 56 surround the outer side of the winding region of the induction heating coil 52 (coil surface 520).

The arch cores 54 may include arch core pieces (540) which are aligned in a plurality of locations at intervals in the longitudinal direction of the heating roller 46, for example. The side cores 56 may be disposed continuously without leaving intervals in the longitudinal direction of the heating roller 46. The total length of the side cores 56 may correspond to the length of the winding region (coil surface 520) of the induction heating coil 52. These cores 54 and 56 may be positioned in accordance with the distribution of the magnetic flux density (magnetic field strength) of the induction heating coil 52, for example. In the portion where the arch core pieces 540 does not exist, the side cores 56 supplementarily focus the magnetic field, which results in a uniform distribution of the magnetic flux (temperature differential) in the longitudinal direction. A resin core holder (not illustrated) may be provided, for example, on the outer side of the arch cores 54 and the side cores 56 to support them. The material of the core holder may be desirably a heat-resistant resin (for example, PPS, PET, LCP).

The fixing unit 14 shown in FIGS. 2A and 2B may include a thermistor 62 which is disposed inside the heating roller 46. Desirably, the thermistor 62 may be disposed in the portion where it is expected that the greatest amount of heat will be generated with induction heating. A thermostat (not illustrated) may be disposed inside the heating roller 46 as well to improve the safety in the event of abnormal temperature rise.

(Center Core)

The center core 58 is a ferrite core (magnetic core) of which cross-section is circular, for example. The center core 58 is long enough to heat the paper in the greatest paper passage width. The center core 58 may be substantially as long as the heating roller 46. The center core 58 is coupled to a drive mechanism (not shown in FIGS. 2A and 2B) which rotates the center core 58 about its longitudinal axis, as described further below.

(Movable Shielding Member (Shielding Pieces))

Furthermore, a movable shielding member 60 may be placed along the outer surface of the center cores 58. The movable shielding member 60 may be in general a kind of a thin arc plate. The movable shielding member 60 may be, for example, buried in the depressed area of the center core 58 as shown in the drawings, or may also be put on the outer surface of the center core 58. The movable shielding member 60 may be attached with a silicone adhesive, for example. The movable shielding member 60 rotates with the center core 58 to switch the path of the magnetic field (magnetic path) generated by the induction heating coil 52. The switching of the magnetic path with the rotation of the center core 58 is described hereinafter.

Desirably, the movable shielding member 60 is formed from a non-magnetic material with good electrical conductivity, for example, oxygen-free copper. A magnetic field perpendicularly penetrating through the movable shielding member 60 produces induction current. This induction current creates an inverse magnetic field which cancels out the interlinkage magnetic flux (the perpendicularly penetrating magnetic field). As a result, the movable shielding member 60 may shield the magnetic field. The movable shielding member 60 with better electrical conductivity may also suppress Joule heating caused by the induction current, which results in more efficient shield for the magnetic field. The following approaches shown below may improve the electrical conductivity of the movable shielding member 60, for example.

(1) Select a material having as low a specific resistance as possible (2) Thicken the movable shielding member Describing more specific case in the present embodiment, the movable shielding member 60 may be, for example, 0.5 mm or greater in thickness. More specifically, the movable shielding member of the present embodiment may be 1 mm in thickness.

(Magnetism Shielding Members)

The IH coil unit 50 further comprises a pair of magnetism shielding members 90. The magnetism shielding members 90 are disposed between the induction heating coil 52 and heating belt 48/heating roll 46. The left and right magnetism shielding members 90 are symmetrical about the center core 58. Referring to FIGS. 2A and 2B, the left and right magnetism shielding members 90 are also symmetrically disposed with respect to the coil center of the induction heating coil 52. The respective magnetism shielding members 90 are fixedly disposed between the induction heating coil 52 and the heating belt 48 (heating roller 46). Furthermore, the magnetism shielding members 90 are partially inserted into the space between the induction heating coil 52 and the heating belt 48 and do not occupy the whole of the space between the induction heating coil 52 and the heating belt 48.

(Magnetism Shielding Members According to a First Structural Example)

Figure 3:
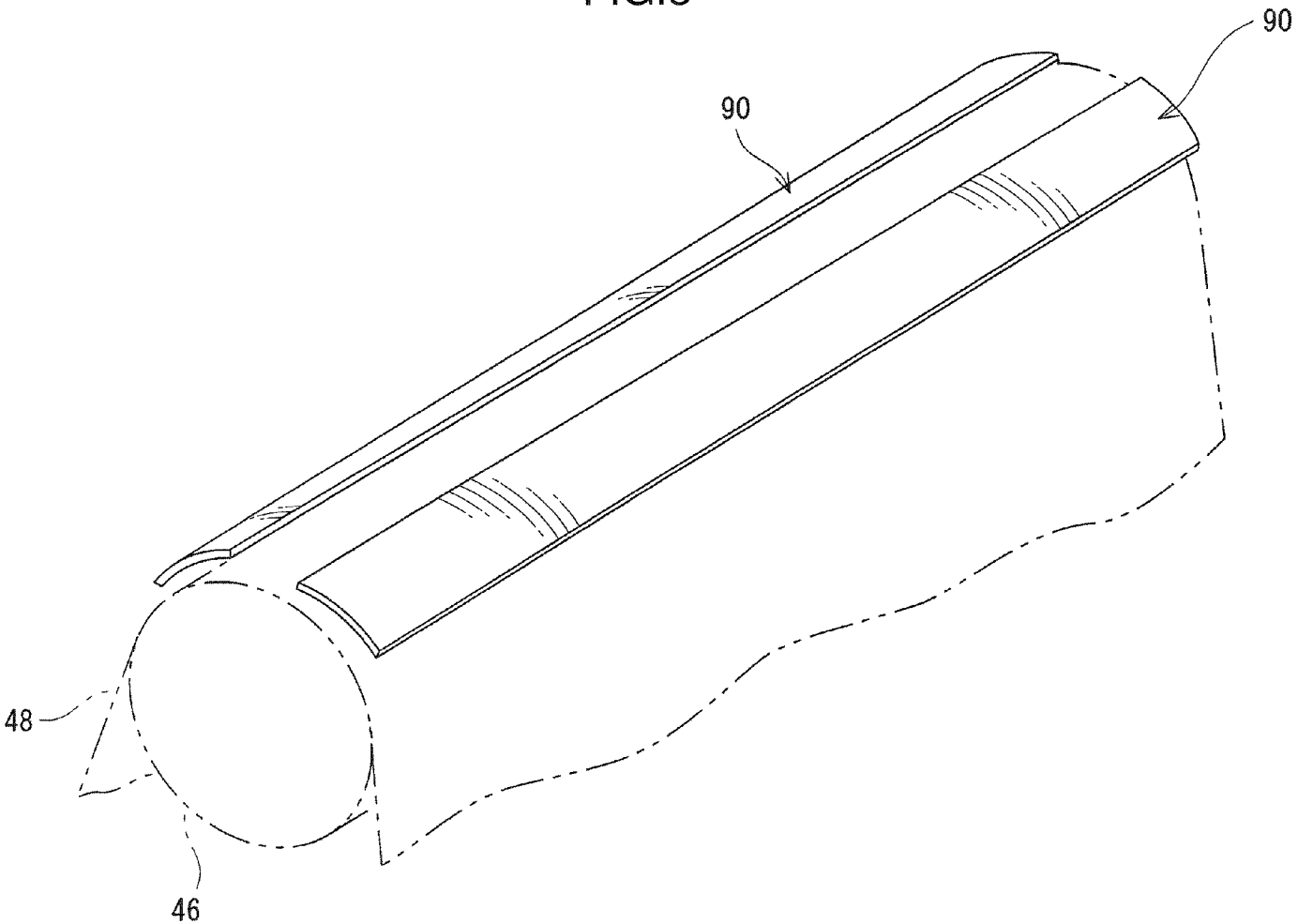
FIG. 3 is a perspective view showing magnetism shielding members according to a first structural example.

FIG. 3 is a diagrammatic perspective view showing magnetism shielding members 90 according to the first structural example. Each of the magnetism shielding members 90 according to the first structural example may be in general a kind of a arc plate. The magnetism shielding member 90 is substantially as long as the heating roller 46. Furthermore, the magnetism shielding member 90 may be 0.5 mm in thickness, for example. Desirably, the magnetism shielding member 90 may be from 0.5 mm to 3.0 mm in thickness. The magnetism shielding member 90 may be bonded (fixed) onto the inner surface of the resin bobbin 500 described above, on which the induction heating coil 52 is wound so as to cover its outer surface.

Figure 4A:
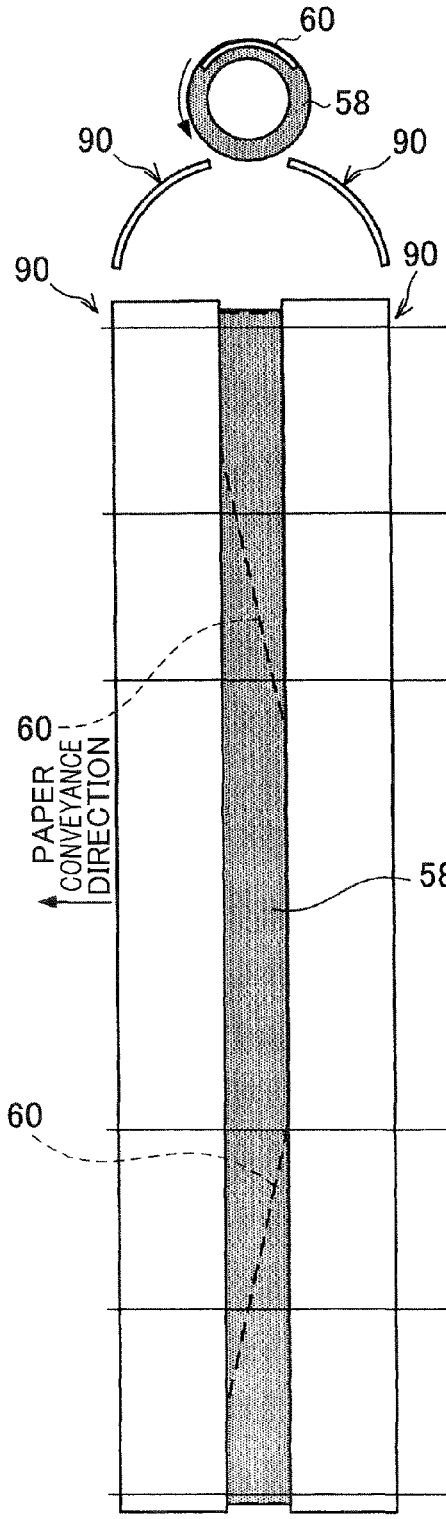
FIG. 4A is a diagram exemplarily showing the magnetism shielding members according to a first structural example.
Figure 4B:
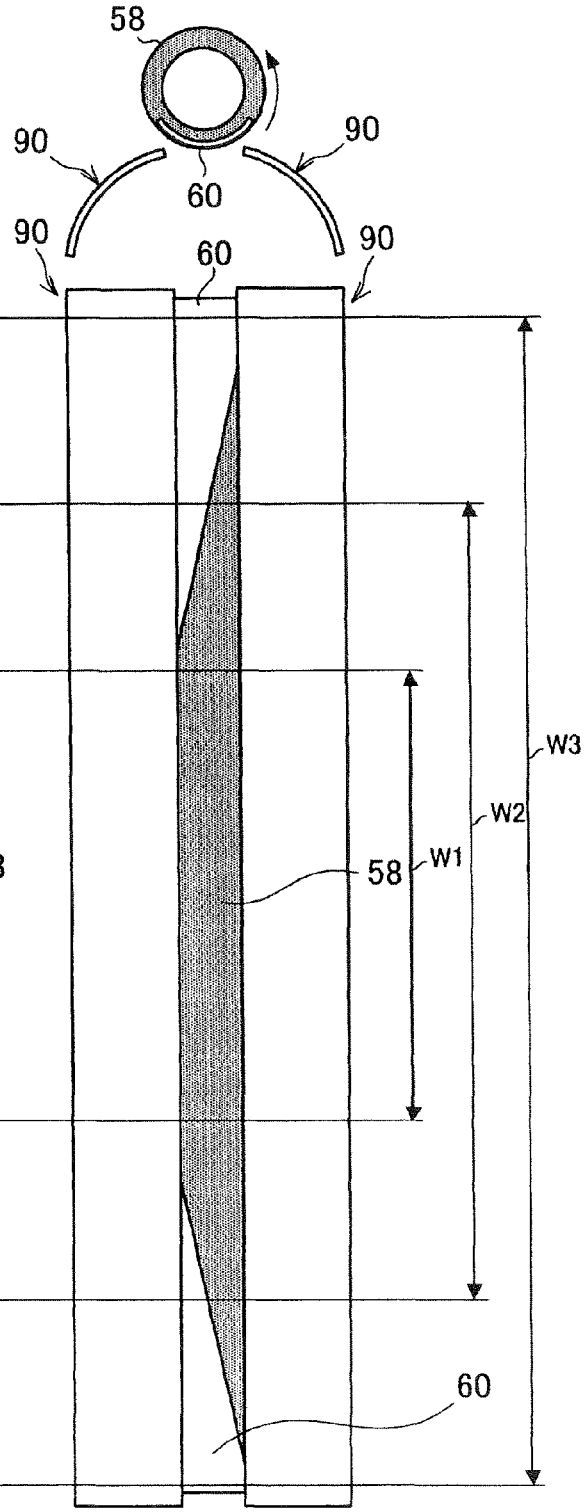
FIG. 4B is a diagram exemplarily showing the magnetism shielding members according to a first structural example.

FIGS. 4A and 4B show the disposition of magnetism shielding members 90 according to the first structural example. The movable shielding member 60 shown in FIG. 4A is in a retracted position, where the movable shielding member 60 is outside the magnetic path. The movable shielding member 60 shown in FIG. 4B is displaced to a shielding position from the retracted position shown in FIG. 4A by the rotation of the center core 58. In the shielding position, the movable shielding member 60 is disposed across the magnetic path. The upper portions in FIGS. 4A and 4B depict a side view of the center core 58 and the magnetism shielding members 90, and their lower portions depict a bottom view of the center core 58 and the magnetism shielding members 90. In FIGS. 4A and 4B, the outer surface of the center core 58 is indicated by the hatched region.

The center core 58 is substantially as long as or longer than the greatest paper passage width W3. The movable shielding member 60 may include two separate pieces which are arranged along the longitudinal axis of the center core 58. The separate pieces of the movable shielding member 60 may be symmetrical each other. The pieces of the movable shielding member 60 may be triangular in plan view or bottom view, for example. The most acute corners of the respective pieces of the movable shielding member 60 may be directed to the longitudinal center of the center core 58. Consequently, at the longitudinal center of the center core 58, the arc length of the movable shielding member 60 becomes shortest, and as closer to the respective side ends of the center core 58, the arc length becomes gradually greater.

Furthermore, the major part of the movable shielding member 60 exists outside a region defined by the smallest paper passage width W1, which is defined as a dimension perpendicular to the paper conveyance direction, and only a minor portion of the movable shielding member 60 exists inside the region of the smallest paper passage width W1. The movable shielding member 60 projects slightly to the outer side of the greatest paper passage width W3 at both ends of the center core 58. The smallest paper passage width W1 and the greatest paper passage width W3 may be determined in accordance with the minimum-size and the maximum-size of papers which the image forming apparatus 1 is capable of handling for printing.

Furthermore, in the present embodiment, the ratio of the arc length of the movable shielding member 60 with respect to the length of the outer circumference of the center core 58 changes with the position in the axial direction of the center core 58 (the position in the longitudinal direction). Here, the ratio between the arc length (Lc) of the movable shielding member 60 and the outer circumferential length (L) may be defined as the coverage rate (Lc/L). The coverage rate becomes smaller toward the central position in the longitudinal direction of the center core 58 while it becomes greater toward the outer sides (both ends of the center core 58) in the longitudinal direction. More specifically, the coverage rate may be minimal in the vicinity of the region of the smallest paper passage width W1 and may be maximal at both ends of the center core 58.

By displacing the movable shielding member 60 between the retracted position and the shielding position, the movable shielding member 60 may switch the magnetic path to control the generated magnetic flux, which leads to adjustment for the amount of heat in accordance with the paper size (paper passage width). The rotation angle of the center core 58 (the amount of rotational displacement) in accordance with the paper size (paper passage width) may be changed so as to decrease the magnetic shielding when the larger paper goes through the fixing unit 14 or so as to increase the magnetic shielding when the smaller paper goes through the fixing unit 14. Thus the excessive temperature rise in both end portions of the heating roller 46 (as well as the heating belt 48) may be prevented. The center core 58 may be rotated in both directions (counter-clockwise or clockwise) although the arrow in FIGS. 4A and 4B just shows clockwise direction. Furthermore, the paper conveyance direction may be the opposite of the direction shown in FIGS. 4A and 4B.

(Magnetism Shielding Members According to Second Structural Example)

Figure 5A:
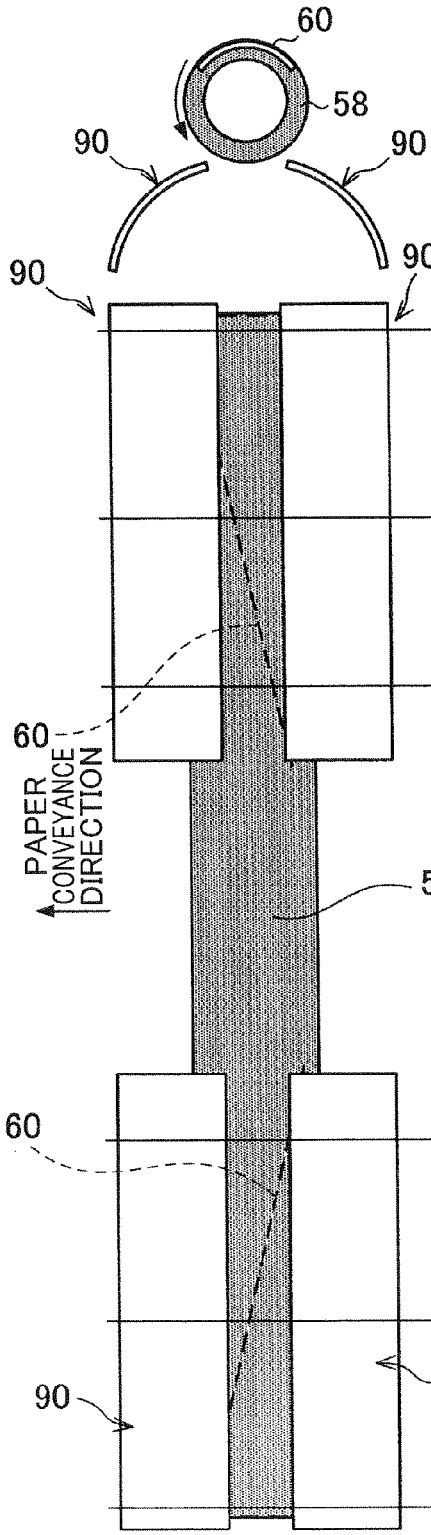
FIG. 5A is a diagram exemplarily showing the magnetism shielding members according to a second structural example.
Figure 5B:
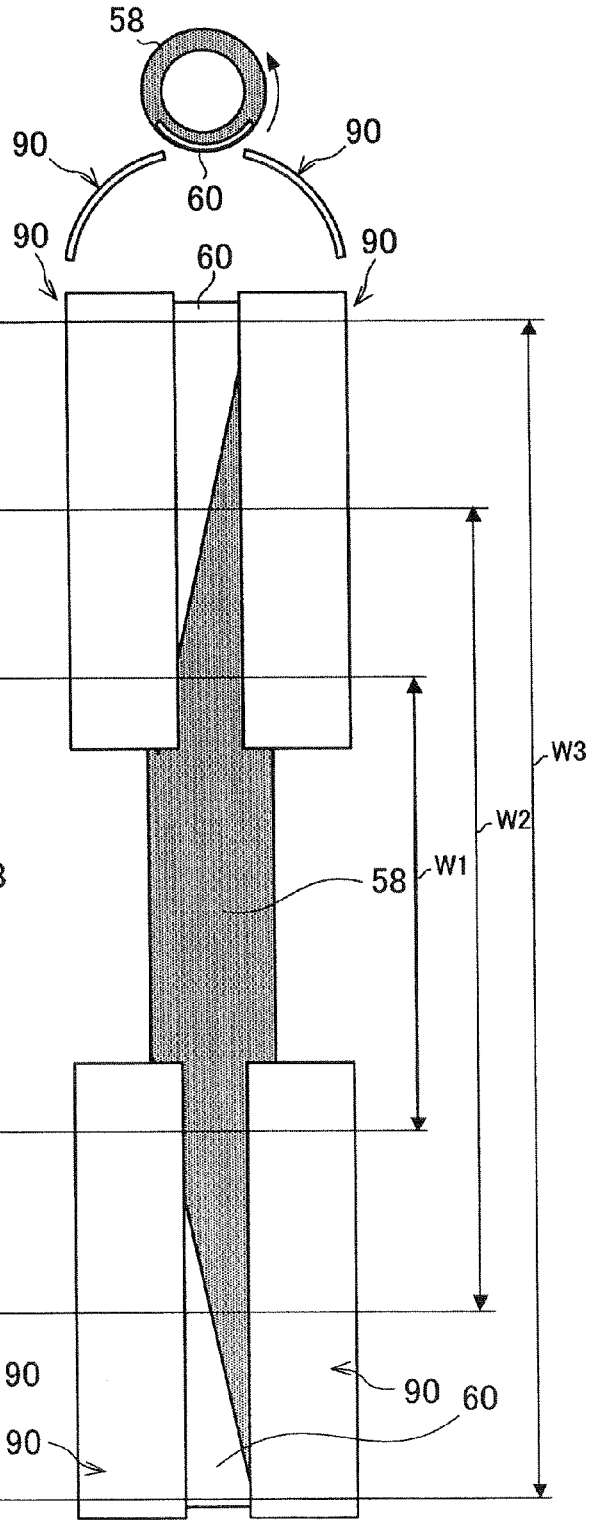
FIG. 5B is a diagram exemplarily showing the magnetism shielding members according to a second structural example.

FIGS. 5A and 5B show the disposition of magnetism shielding members 90 according to a second structural example. In the example shown in FIGS. 5A and 5B, each of magnetism shielding members 90 shown in FIGS. 4A and 4B is divided into two pieces. The divided pieces are arranged in the longitudinal direction (the width direction of the paper). The magnetism shielding members 90 mainly cover the outer region of the smallest paper passage width W1, and hardly cover the smallest paper passage width W1 at all. The magnetism shielding members 90 shown in FIGS. 5A and 5B do not contribute to the magnetic shielding in the region of the smallest paper passage width W1, in which the fixing process is always carried out onto papers. Thus the region of the smallest paper passage width W1 may not require the magnetic shielding by the magnetism shielding members 90, and so the arrangement of the magnetism shielding members 90 according to the second structural example may be applicable.

(Drive Mechanism)

The mechanism configured to rotate the center core 58 about its axis with the movable shielding member 60 between the shielding position and the retracted position to switch the magnetic path, will now be described.

Figure 6:
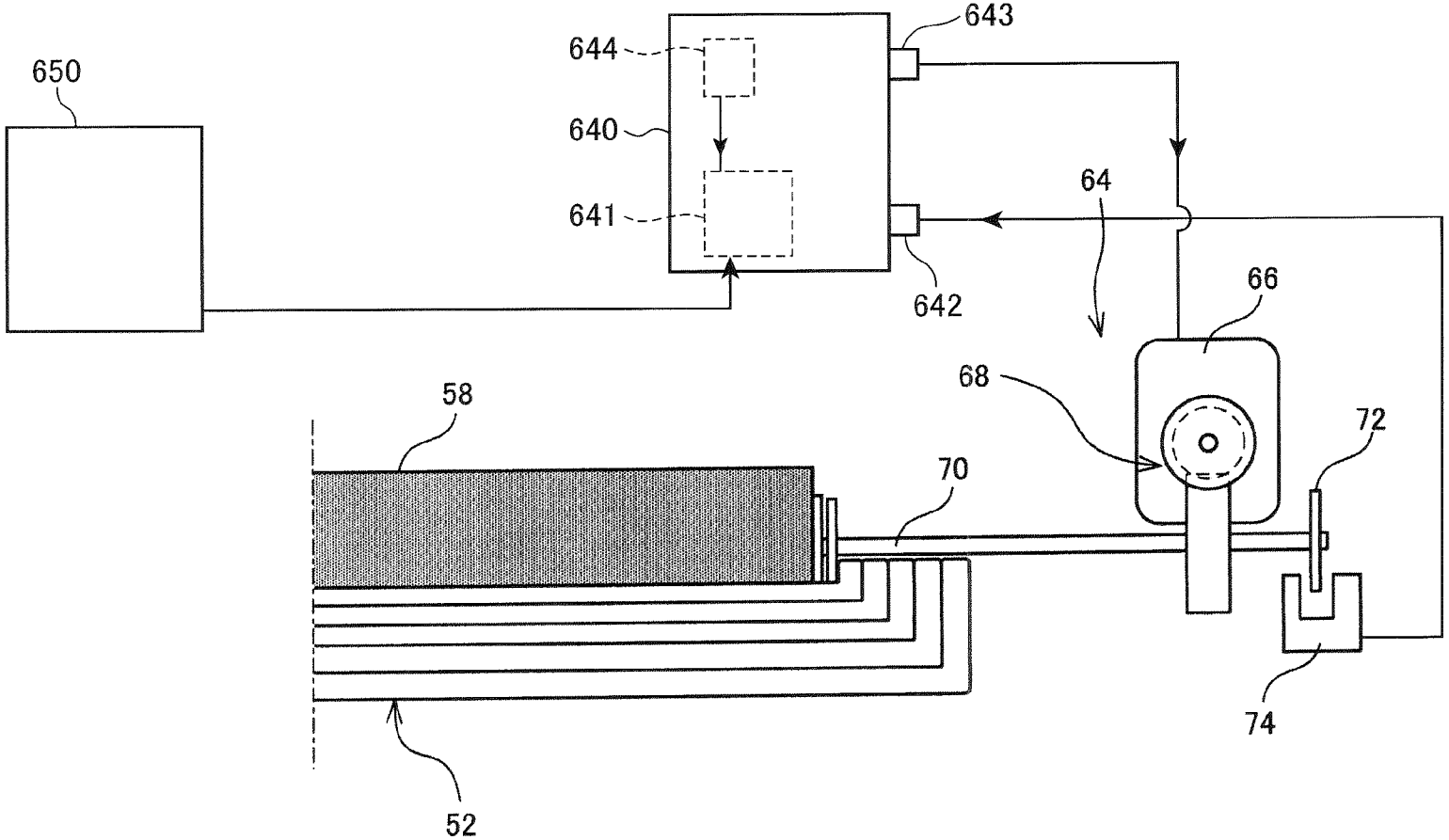
FIG. 6 is a side view diagram showing the composition of the drive mechanism for the center core.

FIG. 6 is a front view diagram showing the elements of the drive mechanism 64 of the center core 58.

The drive mechanism 64 comprises, for example, a stepping motor 66, a reducing mechanism 68 configured to reduce the rotational speed of the stepping motor 66, and a drive shaft 70 extending between the center core 58 and the reducing mechanism 68. The stepping motor 66 rotates the drive shaft 70 of the center core 58. A worm gear, for example, may be used as the reducing mechanism 68, but the present embodiment is not limited to this. The drive mechanism 64 also comprises a slitted disk 72 which is fixed to the end portion of the drive shaft 70, and a photointerrupter 74 configured to determine the rotational angle of the slitted disk 72 (in other words, the rotational angle of the center core 58 (the amount of rotational displacement from the reference position)).

The drive shaft 70 supporting the center core 58 may be coupled to one end portion of the center core 58 and may not pass through the interior of the center core 58. The rotational angle of the center core 58 may be controlled by the number of drive pulses applied to a stepping motor 66, for example. The drive mechanism 64 may further comprise a control circuit 640 configured to control the rotation of the stepping motor 66. The control circuit 640 may yet further comprise, for instance, a control IC 641, an input driver 642, an output driver 643, a semiconductor memory 644, and the like. The determination signal from the photointerrupter 74 is input to the control IC 641 via an input driver 642. The control IC 641 determines the current rotational angle (position) of the center core 58 on the basis of the input signal while an information signal relating to the current paper size is sent to the control IC 641 from an image formation control unit 650 in the image forming apparatus 1. After receiving the information signal from the image formation control unit 650, the control IC 641 reads out the information of the rotational angle corresponding to the paper size from the semiconductor memory (ROM) 644 and outputs drive pulses at prescribed time intervals, so that the center core arrives at the target rotational angle. The drive pulses may be applied to the stepping motor 66 via the output driver 643. The stepping motor 66 operates in accordance with the drive pulses. If it is necessary to determine only the reference position when controlling the stepping motor 66, then it is possible to adopt a structure in which the slitted disk 72 is taken as an index member sensed by the photointerrupter 74 at the reference position.

(Path Switching Device)

Figure 7B:
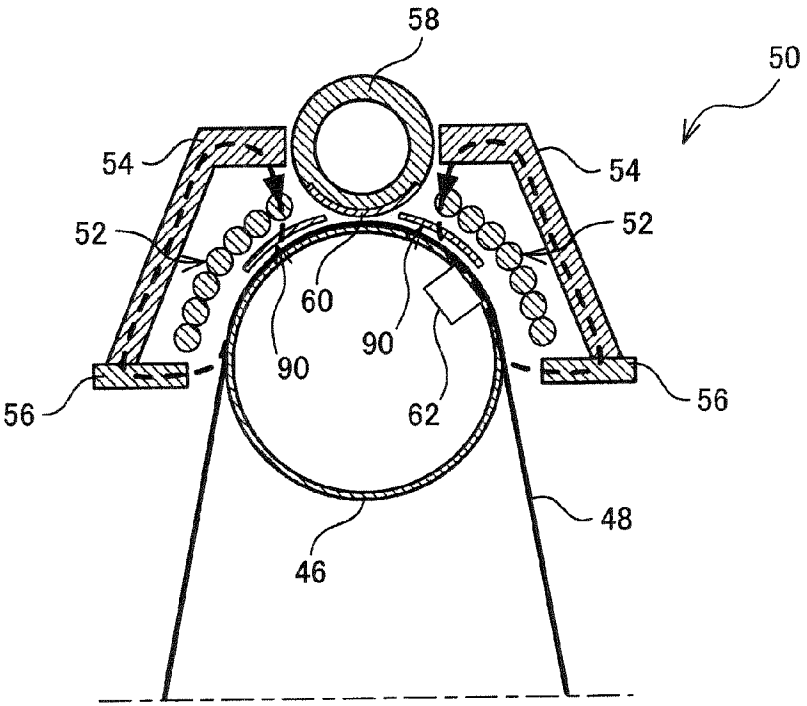
FIG. 7B is a diagram describing the shielding effect for a magnetic field as the rotation of a center core.
Figure 7A:
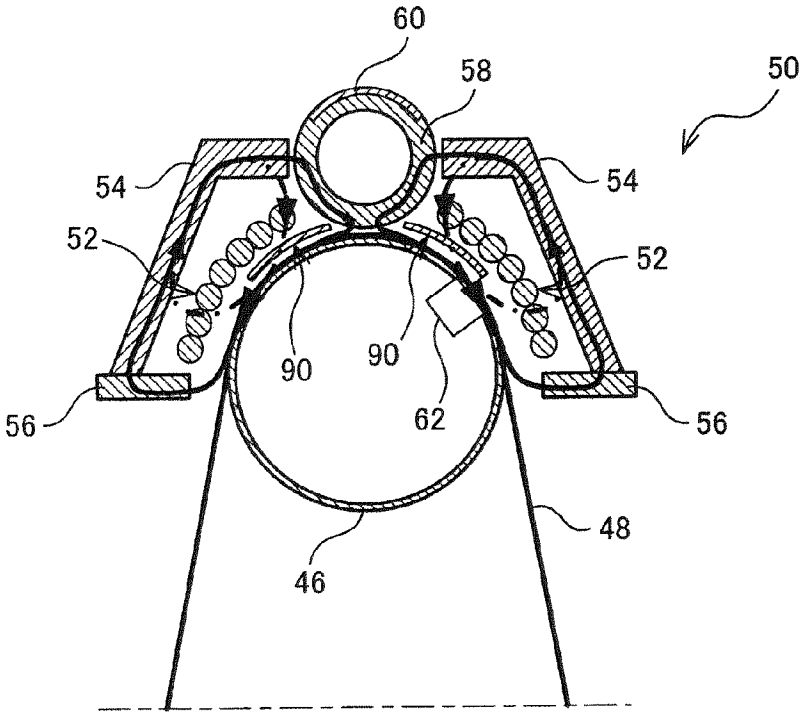
FIG. 7A is a diagram describing the shielding effect for a magnetic field as the rotation of a center core.

FIGS. 7A and 7B are diagrams illustrating effect on suppressing excessive temperature rise due to the rotation of the center core 58. Below, the effect on suppressing excessive temperature rise is described with reference FIG. 7A and FIG. 7B.

(First Path)

FIG. 7A shows the movable shielding member 60 in the retracted position after the rotation of the center core 58.

The induction heating coil 52 generates a magnetic field passes along the first path (indicated by the thick solid lines in FIG. 7A) running through the heating belt 48, the heating roller 46, the side cores 56, the arch cores 54 and the center core 58. In this case, an eddy current occurs in the ferromagnetic heating belt 48 and the ferromagnetic heating roller 46 to generate Joule heat in accordance with their specific resistances. Thus the heating belt 48 and the heating roller 46 is well heated.

In a area surrounded with the magnetic path which passes through the heating belt 48 and the heating roller 46 via the side cores 56, the arch cores 54 and the center core 58, the magnetism shielding members 90 shield the short-cut magnetic flux (indicated by the thick dotted lines), which may leak from the arch cores 54, for example. The magnetism shielding members 90, however, does not prevent the full lengths of the heating belt 48 and the heating roller 46 from being heated because such the short-cut magnetic flux is very minor and hardly contribute to the heat generation.

(Second Path)

FIG. 7B shows the shielding member 60 in the shielding position. FIG. 7B shows a cross-section of the center core 58 in the outer region of the smallest paper passage width W1. As shown in FIG. 7B, the movable shielding member 60 is disposed across the magnetic path indicated by the solid line in FIG. 7A. The movable shielding member 60 and the magnetism shielding members 90 form a shielding surface which prevents the magnetic field from traveling along a path from the center core 58 to the heating belt 48 and the heating roller 46. Thus the magnetic path is switched to a second path (indicated by the thick dotted lines in FIG. 7B) which does not pass through the center core 58, which results in suppressing heat generation outside the region of the smallest paper passage width W1. Thus the excessive temperature rise in the heating belt 48 and the heating roller 46 may be well prevented.

(Function of the Magnetism Shielding Members)

After switching to the second path, the magnetism shielding members 90 supplement the shielding effect of the movable shielding member 60, thereby making it possible to shield the magnetic flux which leaks from the arch cores 54. Therefore, in the present embodiment, the magnetic field may be sufficiently shielded in the non-passage region (the region where paper does not pass), without excessively enlarging the surface area of the movable shielding member 60. Consequently, excessive temperature rise in the heating belt 48 and heating roller 46 may be suppressed more sufficiently, compared with the prior art. When the movable shielding member 60 is located in the retracted position, a weak magnetic flux circulating inside the arch cores 54 (a magnetic flux such as that indicated by the thick dotted line in FIG. 7A) is generated. The fixed magnetism shielding members 90 may sequentially shield such weak magnetic flux even after the movable shielding member 60 moves from the retracted position to the shielding position.

(Magnetism Shielding Members According to Third Structural Example (Looped Magnetism Shielding Members))

Figure 8A:
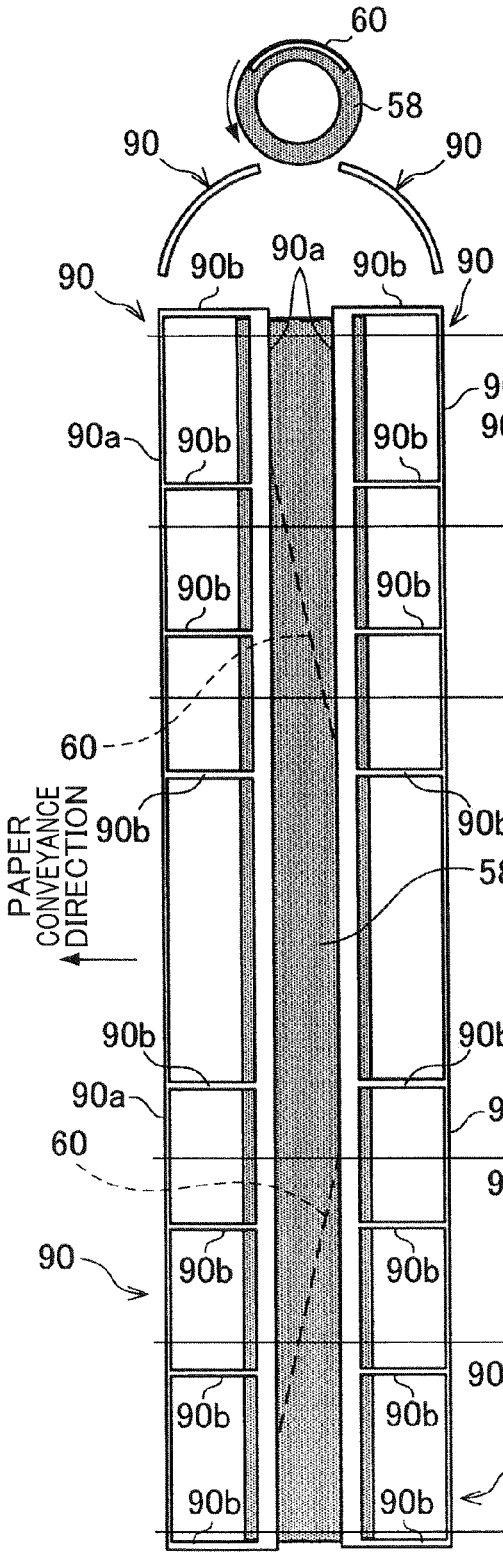
FIG. 8A is a diagram showing magnetism shielding members according to a third structural example.
Figure 8B:
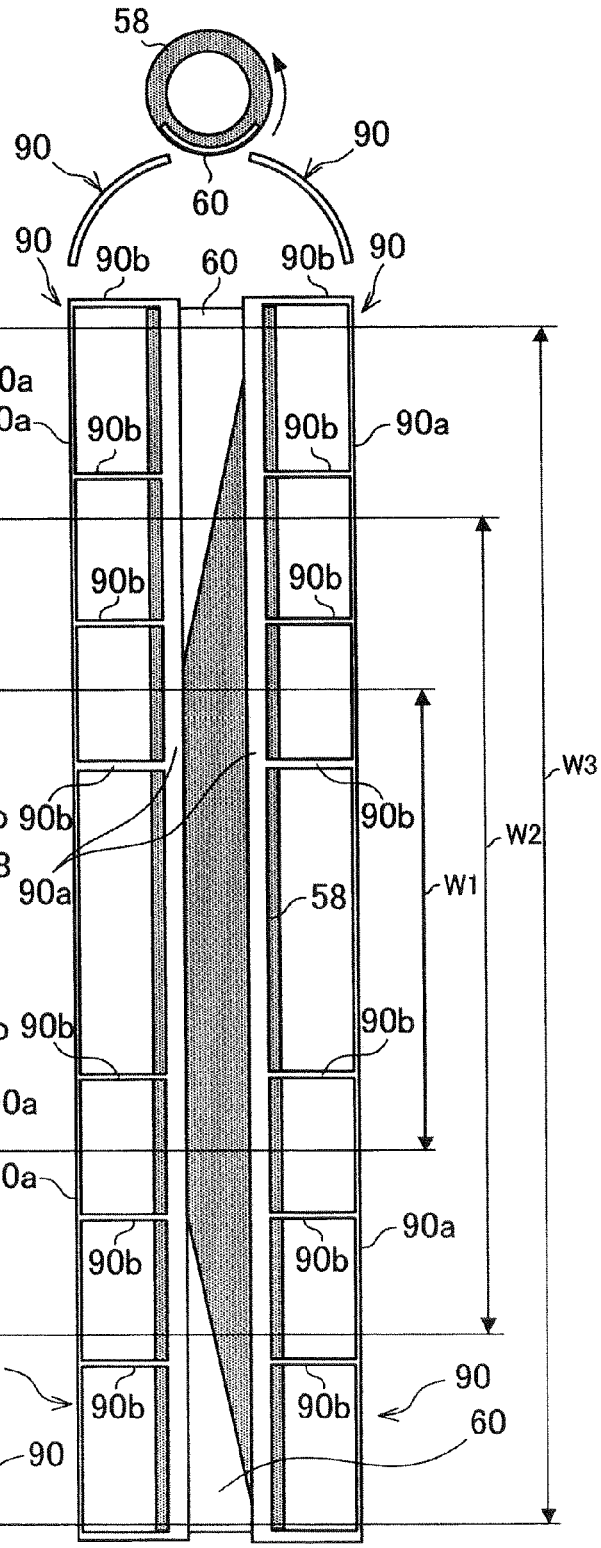
FIG. 8B is a diagram showing magnetism shielding members according to a third structural example.

Next, FIGS. 8A and 8B show magnetism shielding members 90 according to a third structural example. The movable shielding member 60 shown in FIG. 8A is disposed in the retracted position outside the magnetic path. In FIG. 8B, the center core 58 rotates so that the movable shielding member 60 moved from the retracted position shown in FIG. 8A to the shielding position. In the shielding position, the movable shielding member 60 is disposed across the magnetic path. The upper portion in FIGS. 8A and 8B depicts a side view of the center core 58 and the magnetism shielding members 90, and the lower portion depicts a bottom view of the center core 58 and the magnetism shielding members 90. In FIGS. 8A and 8B, the outer surface of the center core 58 is indicated by the hatched region.

Referring to the lower portion of FIGS. 8A and 8B, the magnetism shielding members 90 according to the third structural example include a plurality of square loops which are arranged in the longitudinal direction of the center core 58. These magnetism shielding members 90 may be formed by stamping out the magnetism shielding members 90 of the first structural example to form a plurality of square holes which are adjacent each other. The magnetism shielding members 90 may be also made from non-magnetic metal (for instance, oxygen-free carbon). As shown in the upper portion of FIGS. 8A and 8B, similarly to the first and second structural examples, the magnetism shielding members 90 may include an arc profile in general.

The individual square loops comprise a pair of straight line portions 90*a* which extend in the longitudinal direction of the center core 58 and a pair of circular arc portions 90*b* which extend in the paper conveyance direction. The magnetism shielding members 90 according to the third structural example may be also bonded to the inner surface of the resin bobbin 500.

The respective loops which the magnetism shielding members 90 include and which are arranged in the longitudinal direction of the center core 58 individually provide magnetism shielding effects. Therefore, the respective loops may be disposed so as to correspond to the paper passage widths W1, W2, W3 stated above. The magnetism shielding effect created by the loops is described below.

Figure 9A:
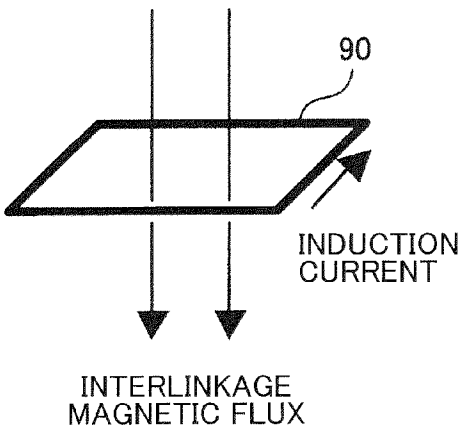
FIG. 9A is a conceptual diagram describing the characteristics which the loops of the magnetism shielding members provides.
Figure 9B:
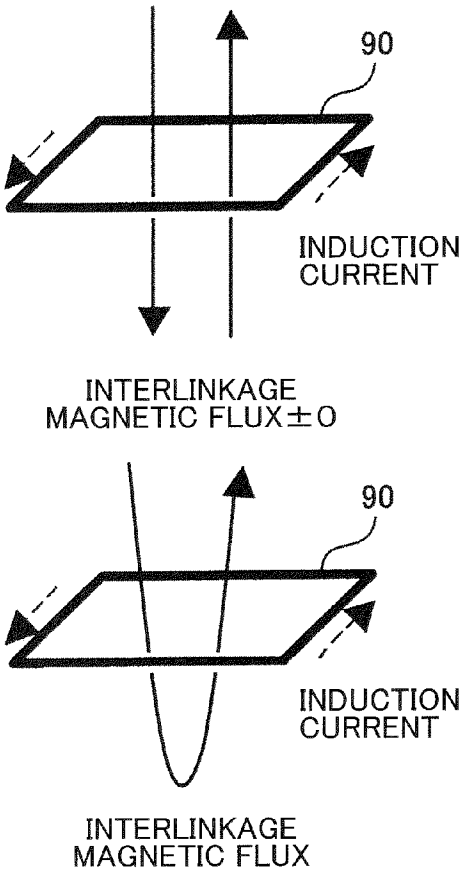
FIG. 9B is a conceptual diagram describing the characteristics which the loops of the magnetism shielding members provides.
Figure 9C:
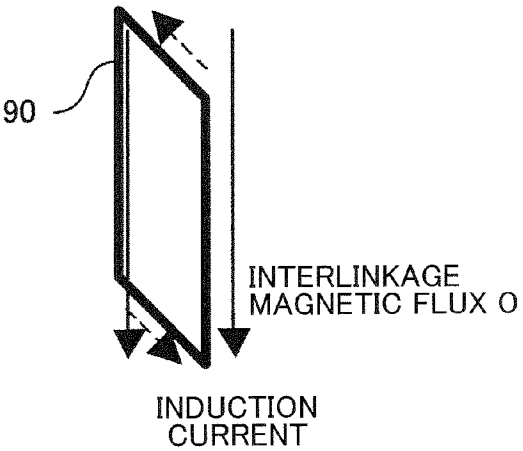
FIG. 9C is a conceptual diagram describing the characteristics which the loops of the magnetism shielding members provides.

FIGS. 9A to 9C are conceptual diagrams for describing the characteristics of the looped magnetism shielding members 90. In order to clarify the description, FIG. 9A to FIG. 9C show only one of loops which the magnetism shielding members 90 include, but the phenomena described below may be applied to all of the loops in the magnetism shielding member 90.

Reference is now made to FIG. 9A, which shows the unidirectional penetrating magnetic field (interlinkage magnetic flux). The interlinkage magnetic flux perpendicularly passes the surface (virtual plane) of the loop. This interlinkage magnetic flux generates an induction current which flows along the loop. Due to the electromagnetic induction caused by the induction current, a magnetic field (opposing magnetic field) which is reversed with respect to the penetrating magnetic field is generated, so that the reverse magnetic flux balance out the interlinkage magnetic flux, thus the magnetic field is cancelled out. In the present embodiment, when the movable shielding member 60 is moved to the shielding position to switch the magnetic path to the second path, this magnetic field cancellation resulting from the magnetism shielding members 90 supplements the magnetism shielding effect.

Reference is now made to FIG. 9B, the upper portion of which shows the bidirectional penetrating magnetic field (interlinkage magnetic flux). The bidirectional penetrating magnetic field perpendicularly passes the surface (virtual plane) of the loop. The total of this interlinkage magnetic flux (balance) is generally around 0 (±0). In this case, no induction current is virtually generated in the loop of the magnetism shielding member 90. Therefore, each loop hardly generates any effect on canceling the magnetic field. The bidirectional magnetic field passes straight through the magnetism shielding member 90. This also occurs similarly in a case where a magnetic field traveling in a U-turn passes through the inner side of the loop, as shown in the lower portion of the diagram in FIG. 9B.

If the magnetism shielding member 90 includes a plurality of loops as in the third structural example, then provided that the balance of magnetic flux flowing out and flowing in on the inside of the loop is zero, then the magnetism shielding member 90 does not affect the heat generation. Therefore, while the movable shielding member 60 is located in the retracted position, the magnetism shielding members 90 do not affect at all the magnetic flux passing in a U turn inside the loops of the magnetism shielding members 90. Thus, the magnetism shielding members 90 may avoid reduction in the heat generation as much as possible.

Reference is now made to FIG. 9C, which shows a magnetic field in parallel with the surface of the loop (interlinkage magnetic flux). In this case, similarly to the case shown in FIG. 9B, no induction current is also virtually generated in the respective loops, which results in no cancellation of the magnetic field. This pattern may not be applied to the present embodiment.

The present inventors figured out that an effect of shielding magnetism as shown in FIG. 9A and an effect of not shielding magnetism as shown in FIG. 9B are obtained with the proposed magnetism shielding members 90 including a plurality of loops according to the third structural example. Magnetism shielding members 90 including a plurality of loops according to the third structural example supplement the magnetism shielding effect of the movable shielding member 60 in the shielding position, and furthermore hardly affect the magnetic field when the movable shielding member 60 is situated in the retracted position.

(Magnetism Shielding Members According to Fourth Structural Example)

Figure 10:
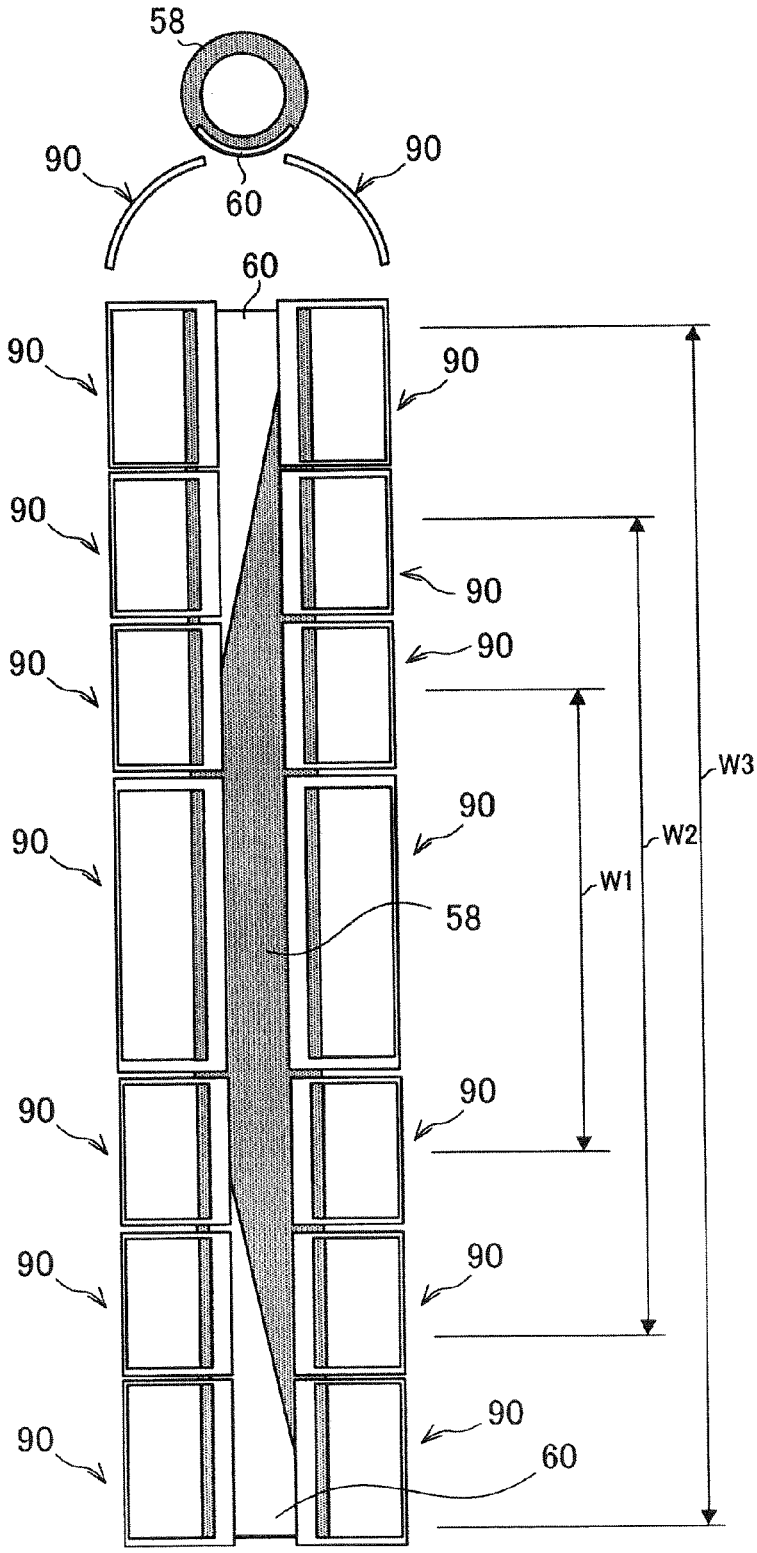
FIG. 10 is a diagram showing magnetism shielding members according to a fourth structural example.

FIG. 10 shows magnetism shielding members 90 according to a fourth structural example. The movable shielding member 60 shown in FIG. 10 is situated in the shielding position. The magnetism shielding members 90 according to the fourth structural example include a plurality of loops which are separated each other and are not mutually connected. Furthermore, similarly to the third structural example, each loop may correspond to different paper passage widths W1, W2, W3 which are defined by the size of paper. For example, in the case of the minimum paper size (smallest paper passage width W1), the three magnetism shielding members 90 on each of the outer sides (a total of 12 magnetism shielding members 90) may generate an effect on shielding magnetism. In this case, a strong magnetic flux does not flow into the loops of the magnetism shielding members 90 which are positioned inside the smallest paper passage width W1, and a magnetism shielding effect is not produced in these loops. Furthermore, if the paper size is in the range from the smallest size to intermediate size (from the smallest paper passage width W1 to the intermediate paper passage width W2 or less), then the loops of two magnetism shielding members 90 on each of the outer sides (a total of eight magnetism shielding members 90) supplements the magnetism shielding effect. In the case of the largest paper size (greatest paper passage width W3), no induction current is generated in any of the loops of the magnetism shielding members 90, thus the magnetic field generated by the induction heating coil 52 may not be affected by the magnetism shielding members 90.

(Magnetism Shielding Members According to Fifth Structural Example)

Figure 11:
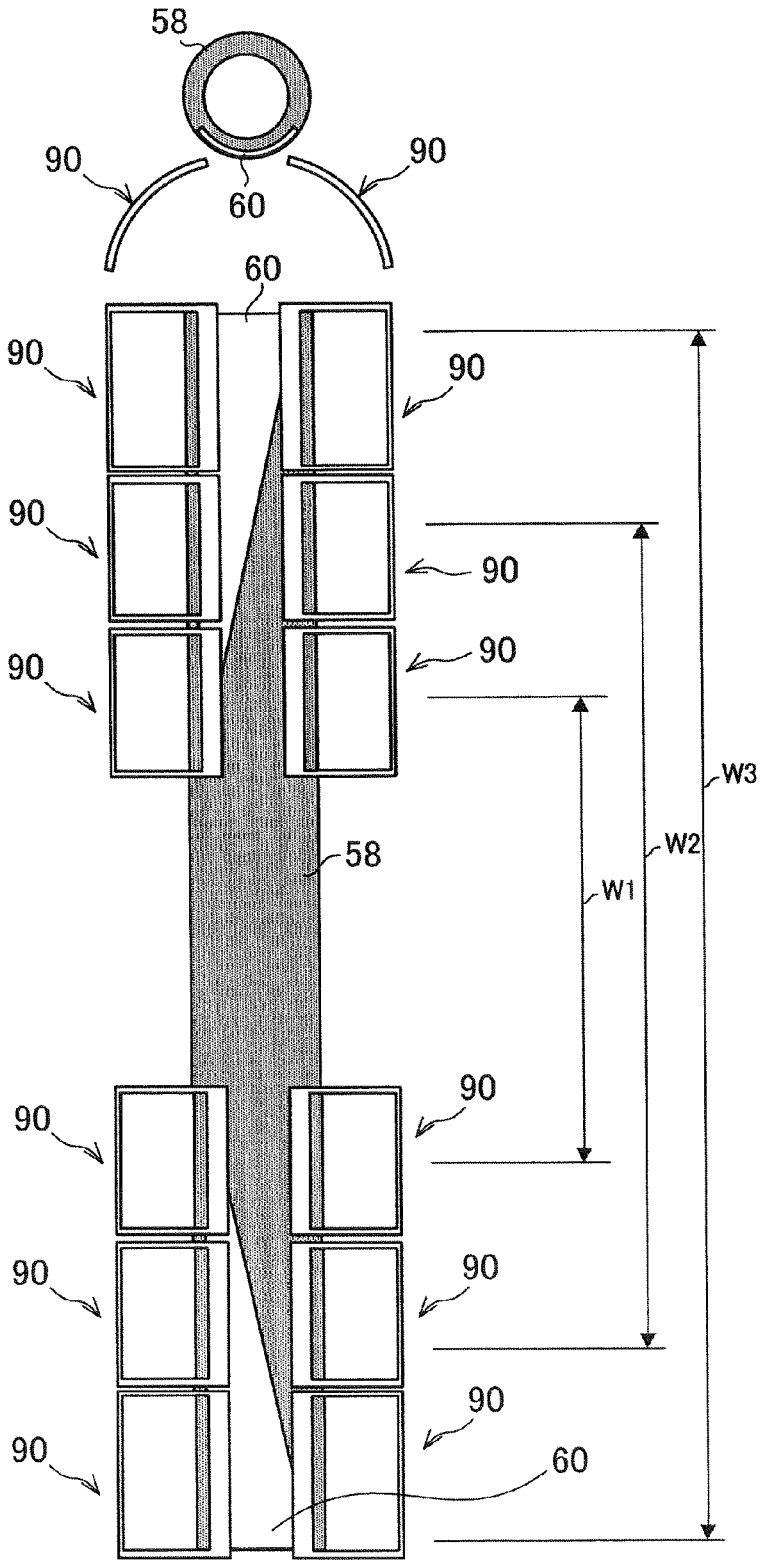
FIG. 11 is a diagram showing magnetism shielding members according to a fifth structural example.

Furthermore, FIG. 11 shows a magnetism shielding member 90 according to a fifth structural example. In the magnetism shielding members 90 according to the fifth structural example, the magnetism shielding members 90 disposed inside the smallest paper passage width W1 are removed from the fourth structural example. Other structure of the fifth structural example may be similar to that of the fourth structural example, and therefore repeated description is omitted here.

(Magnetism Shielding Members According to Sixth Structural Example)

Figure 12A:
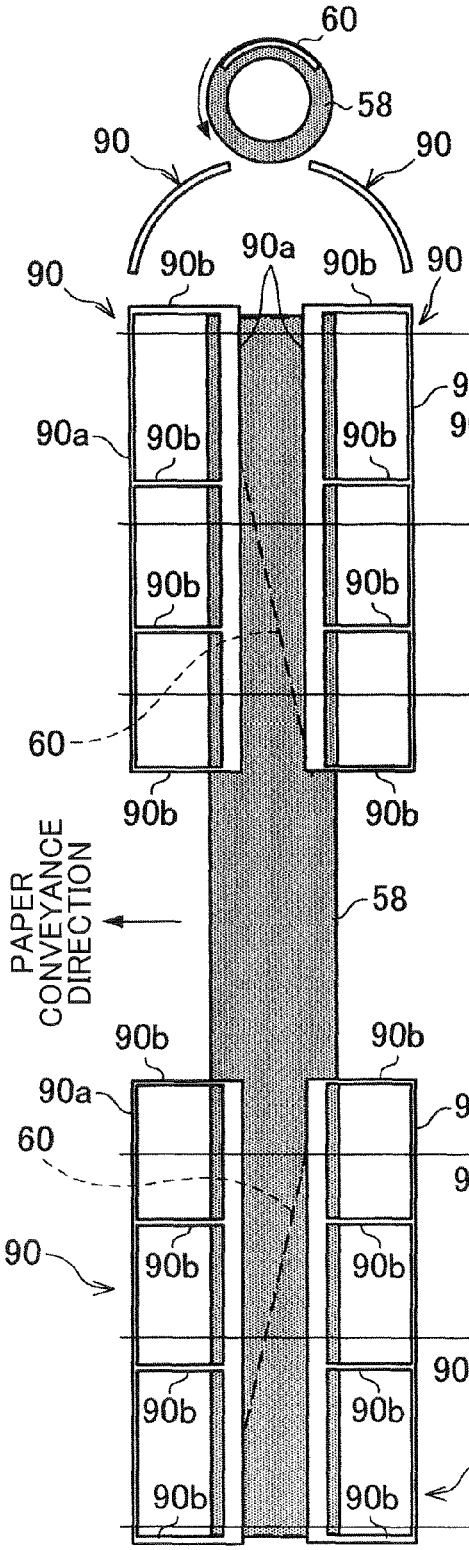
FIG. 12A is a diagram showing magnetism shielding members according to a sixth structural example.
Figure 12B:
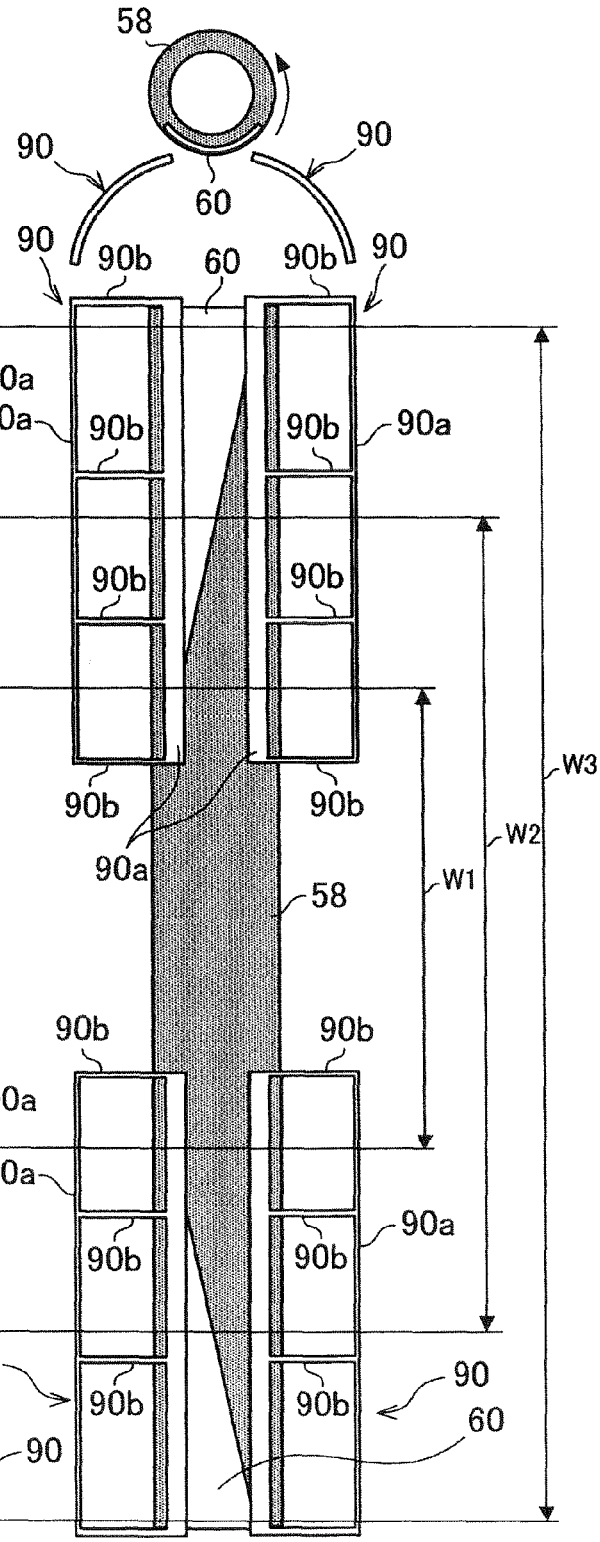
FIG. 12B is a diagram showing magnetism shielding members according to a sixth structural example.

FIGS. 12A and 12B show magnetism shielding members 90 according to a sixth structural example. In this sixth structural example, each of the magnetism shielding members 90 of the third structural example (FIGS. 8A and 8B) is divided into two pieces, and these two pieces are disposed respectively on both of the outer region of the smallest paper passage width W1. Other structure of the sixth structural example is similar to that of the third structural example.

(Magnetism Shielding Members According to Seventh Structural Example)

Figure 13:
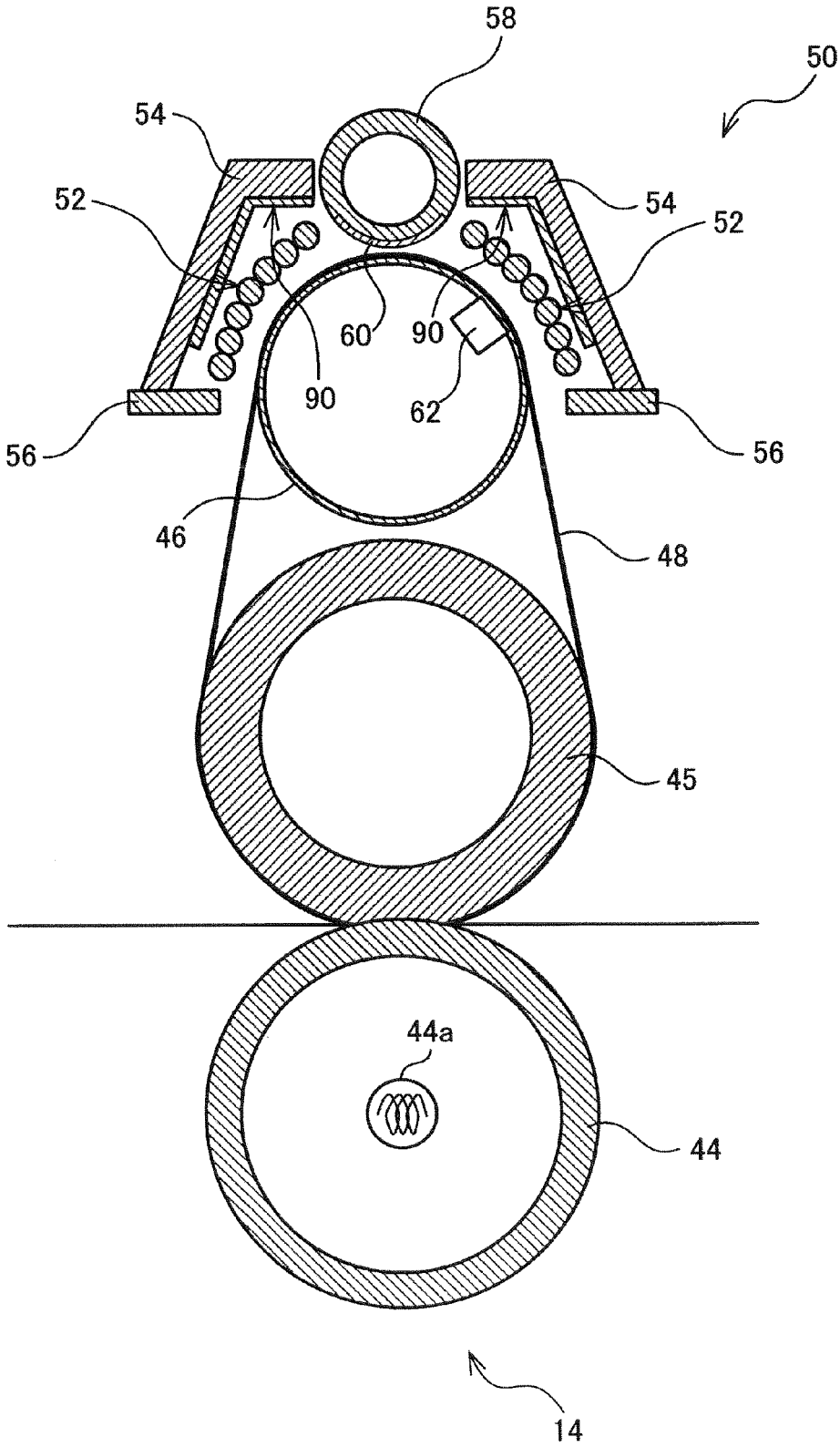
FIG. 13 is a diagram showing magnetism shielding members according to a seventh structural example.

FIG. 13 shows a magnetism shielding member 90 according to a seventh structural example. In contrast to the first to sixth structural examples described thus far, magnetism shielding members 90 according to the seventh structural example are disposed between the arch cores 54 and the induction heating coil 52.

The left and right magnetism shielding members 90 are symmetrically arranged about the coil center of the induction heating coil 52, and are fixed between the arch cores 54 and the induction heating coil 52 (in this example, on the inner surface of the arch cores 54). The magnetism shielding members 90 cover a portion rather than all of the inner surface regions of the arch cores 54.

Figure 14B:
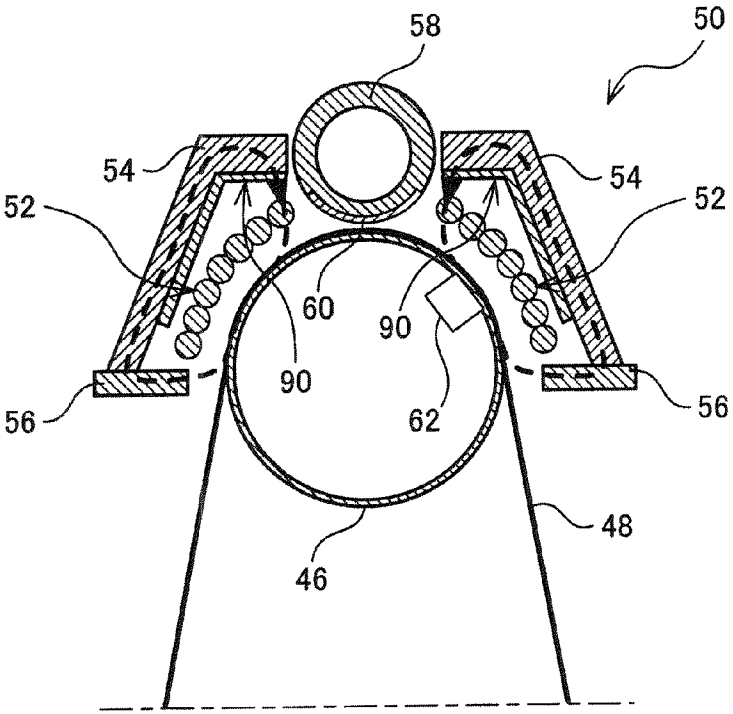
FIG. 14B is a diagram describing the shielding effect for a magnetic field as the rotation of a center core when using magnetism shielding members according to a seventh structural example.
Figure 14A:
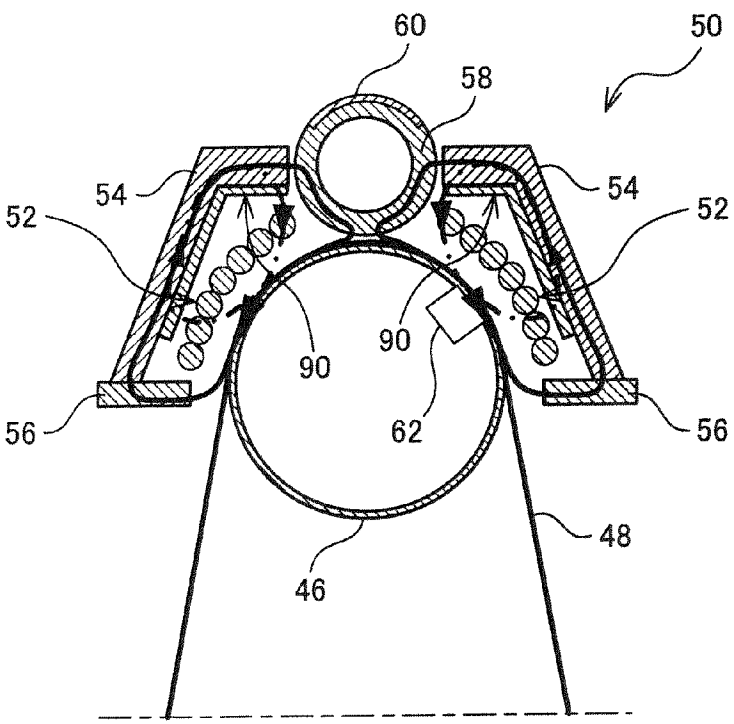
FIG. 14A is a diagram describing the shielding effect for a magnetic field as the rotation of a center core when using magnetism shielding members according to a seventh structural example.

FIGS. 14A and 14B are diagrams illustrating the effect on suppressing excessive temperature rise due to the rotation of the center core 58 according to the seventh structural example. Below, the effect on suppressing excessive temperature rise is described with reference FIG. 14A and FIG. 14B.

(First Path)

FIG. 14A shows the movable shielding member 60 moved to the retracted position due to the rotation of the center core 58. The induction heating coil 52 generates a magnetic field which passes along the first path (indicated by the thick solid lines in FIG. 14A) which runs into the heating belt 48, the heating roller 46, the side cores 56, the arch cores 54 and the center core 58. In this case, an eddy current occurs in the ferromagnetic heating belt 48 and the ferromagnetic heating roller 46, which results in Joule heat generation in accordance with the specific resistance of the ferromagnetic heating belt 48 and the ferromagnetic heating roller 46. Thus the heating belt 48 and the heating roller 46 are well heated. The short-cut magnetic flux (indicated by the thick dotted lines), which may leak from the arch cores 54, for example are shown in the area surrounded with the magnetic path which passes through the heating belt 48 and the heating roller 46 via the side cores 56, the arch cores 54 and the center core 58. The magnetism shielding members 90 may shield the short-cut magnetic flux, which is too slight to contribute at all to the heat generation. Therefore the magnetism shielding members 90 may not prevent the full length of the heating belt 48 and the heating roller 46 from being heated.

(Second Path)

FIG. 14B shows the movable shielding member 60 moved to the shielding position. FIG. 14B is a cross-section of the center core 58 outside the region of the smallest paper passage width W1. As shown in FIG. 14B, the movable shielding member 60 is disposed across the magnetic path indicated by the solid line in FIG. 14A. The movable shielding member 60 and the magnetism shielding members 90 form a shielding surface which prevents the magnetic field from traveling along a path toward the heating belt 48 and the heating roller 46 via the center core 58. Thus the magnetic path switches to a second path (indicated by the thick dotted lines in FIG. 14B) which does not pass through the center core 58. This results in suppressing the amount of heat generated outside the region of the smallest paper passage width W1 to prevent excessive temperature rise in the heating belt 48 or the heating roller 46. Furthermore, similarly to the other structural examples, while the magnetic path is switched to the second path, the magnetism shielding members 90 may shield the magnetic flux that may leak from the arch cores 54, so that the magnetism shielding members 90 supplements the shielding effect of the movable shielding member 60.

(Optimal Conditions)

Figure 15:
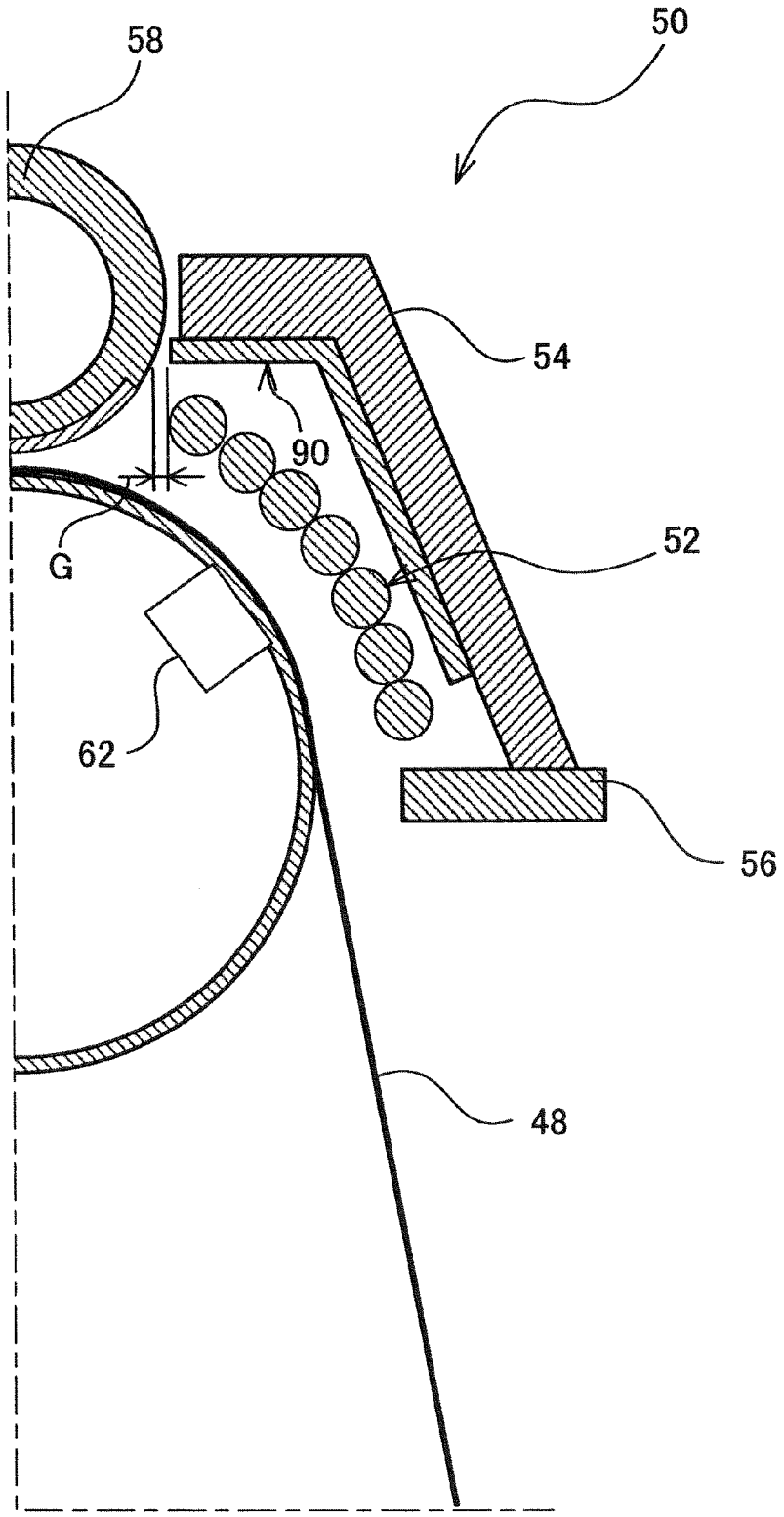
FIG. 15 is a diagram representing the positional relationship between the center core and the magnetism shielding members.

FIG. 15 is a diagram representing the conditions relating to the positional relationship between the center core 58 and the magnetism shielding members 90. The present inventors propose the following optimal conditions for a case where magnetism shielding members 90 are fixed to the inner surface of the arch cores 54 as in the seventh structural example.

(1) Desirably, the magnetism shielding members 90 may be disposed as closely as possible to the center core 58.

(2) In relation to condition (1) above, desirably, the gap between the outer circumferential surface of the center core 58 and the edge of the magnetism shielding member 90 (reference symbol G in FIG. 15) may be approximately 0.5 mm, for example.

As a result of experimentation actually carried out by the present inventors, the magnetism shielding members 90 of the seventh structural example, which were disposed according to the optimal conditions as stated above, provided a better magnetism shielding effect when the magnetic path was switched to the second path.

As described above, a variety of structural examples (first to seventh structural examples) of the magnetism shielding members 90 may be applicable to the fixing unit 14. The fixing units 14 according to the second to fifth examples described below may be also useful instead of the first embodiment. The respective embodiments are described below. Equivalent parts or element to that of the first embodiment may be represented with common reference numerals in the following description as well as drawings, and repeated description thereof is omitted here. Additional descriptions may be provided below when the materials or the like differ from the first embodiment even if the common reference numerals are used for some parts.

Fixing Unit According to a Second Embodiment

Figure 16:
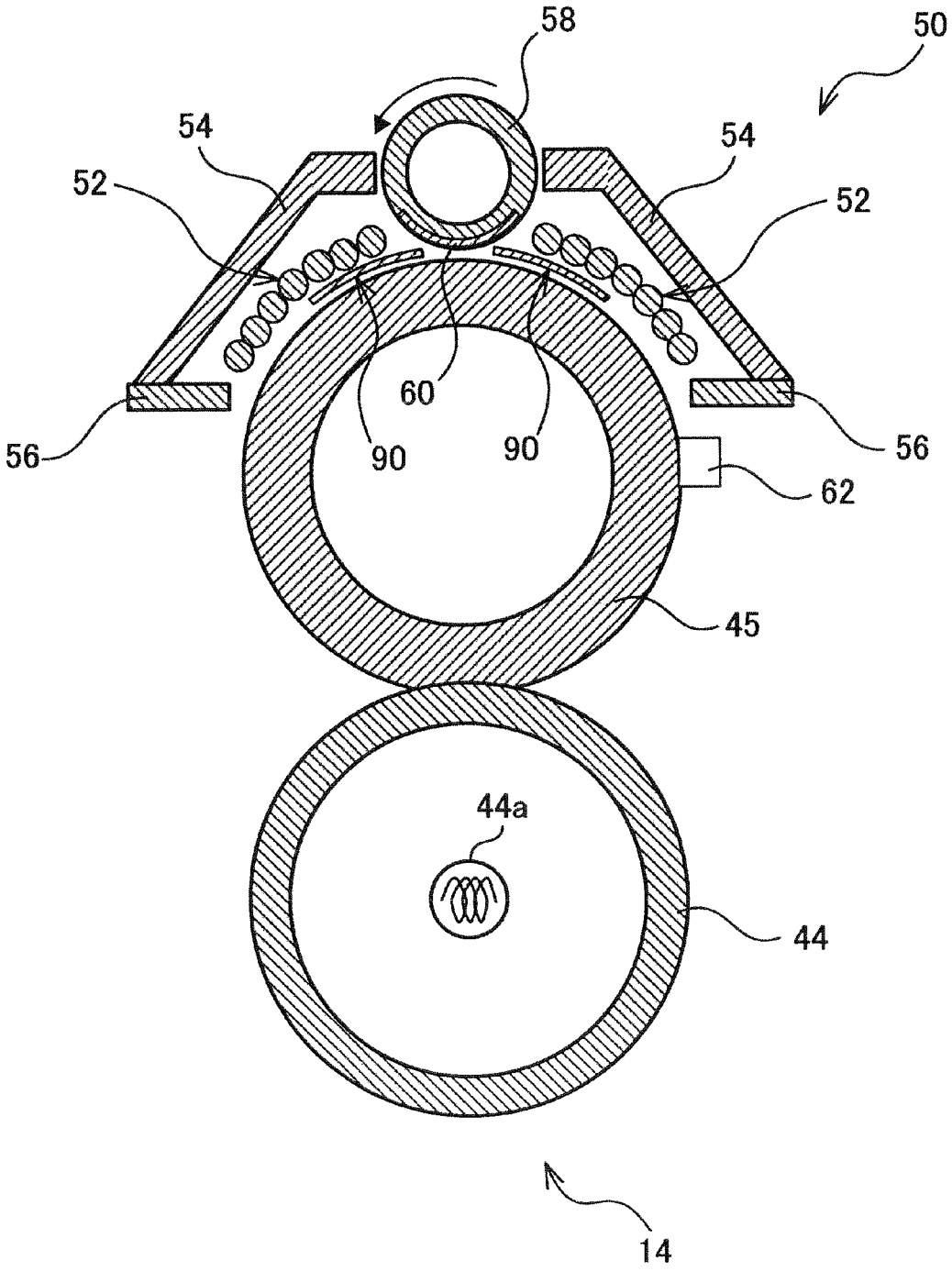
FIG. 16 is a diagram showing a fixing unit according to a second embodiment.

FIG. 16 shows a fixing unit 14 according to the second embodiment. The fixing unit 14 according to the second embodiment does not comprise a heating belt, which is different from the fixing unit 14 of the first embodiment. According to the second embodiment, a fixing roller 45 and a pressurization roller 44 fix the toner image on papers. Similarly to the heating belt of the fixing unit 14 of the first embodiment, a magnetic body may be wound around the outer circumference of the fixing roller 45, for example, to be inductively heated by the induction heating coil 52. A thermistor 62 may be disposed on the outer side of the fixing roller 45 and faces the magnetic layer.

As shown in FIG. 16, the magnetism shielding members 90 according to the first embodiment may be applicable to the fixing unit 14 according to the second embodiment. Furthermore, the magnetism shielding members 90 according to the second to seventh structural examples may be also applicable to the fixing unit 14 according to the second embodiment.

Others may be similar to the first embodiment, therefore the shielding amount for the magnetic field may be adjusted by the rotation of the center core 58. Furthermore, the magnetism shielding members 90 may also be disposed between the induction coil 52 and the fixing roller 45 or be fixed to the inner surface of the arch cores 54.

Fixing Unit According to a Third Embodiment

Figure 17:
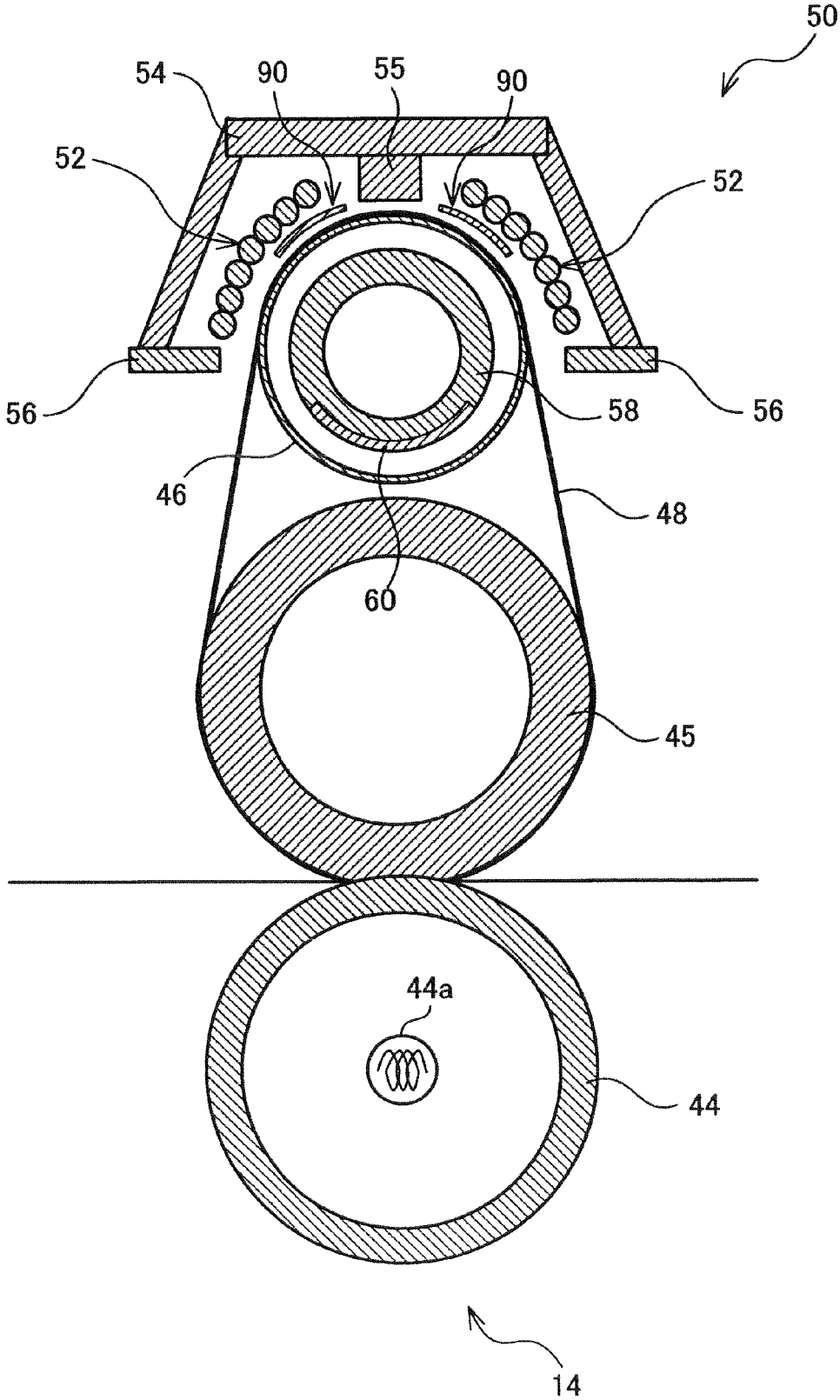
FIG. 17 is a diagram showing a fixing unit according to a third embodiment.

FIG. 17 is a vertical cross-sectional diagram showing a fixing unit 14 according to the third embodiment. According to the third embodiment, the heating roller 46 is made of a non-magnetic metal (for example, stainless steel) and the center core 58 is disposed inside the heating roller 46, which are different from the first embodiment. Furthermore, in contrast to the first embodiment, left and right arch cores 54 are connected at the center of the fixing unit 14. Moreover, an intermediate core 55 is disposed on the lower surface of the arch core (at its central position). The magnetism shielding members 90 are disposed between the induction heating coil 52 and the heating belt 48.

If the heating roller 46 is made of a non-magnetic metal, then the magnetic field generated by the induction heating coil 52 passes through the side cores 56, the arch cores 54 and the intermediate core 55, and penetrates through the heating roller 46 to the center core 58 therein. The heating belt 48 is inductively heated by the penetrating magnetic field.

In the fixing unit 14 according to the third embodiment, the movable shielding member 60 shown in FIG. 17 is in the retracted position where the movable shielding member 60 is distanced from the intermediate core 55. The movable shielding member 60 in the retracted position may not cause magnetism shielding effect and the region of the greatest paper passage width W3 of the heating belt 48 is inductively heated. On the other hand, when the movable shielding member 60 is moved to the position nearest to the intermediate core 55 (the shielding position), then the magnetic path is switched to the second path so that excessive temperature rise outside the paper passage region is suppressed.

As shown in FIG. 17, the magnetism shielding members 90 according to the first structural example may be applicable to the fixing unit 14 according to the third embodiment described above. Furthermore, the magnetism shielding members 90 according to the second to seventh structural examples may also be applicable to the fixing unit 14 according to the third embodiment.

Fixing Unit According to a Fourth Embodiment

Figure 18:
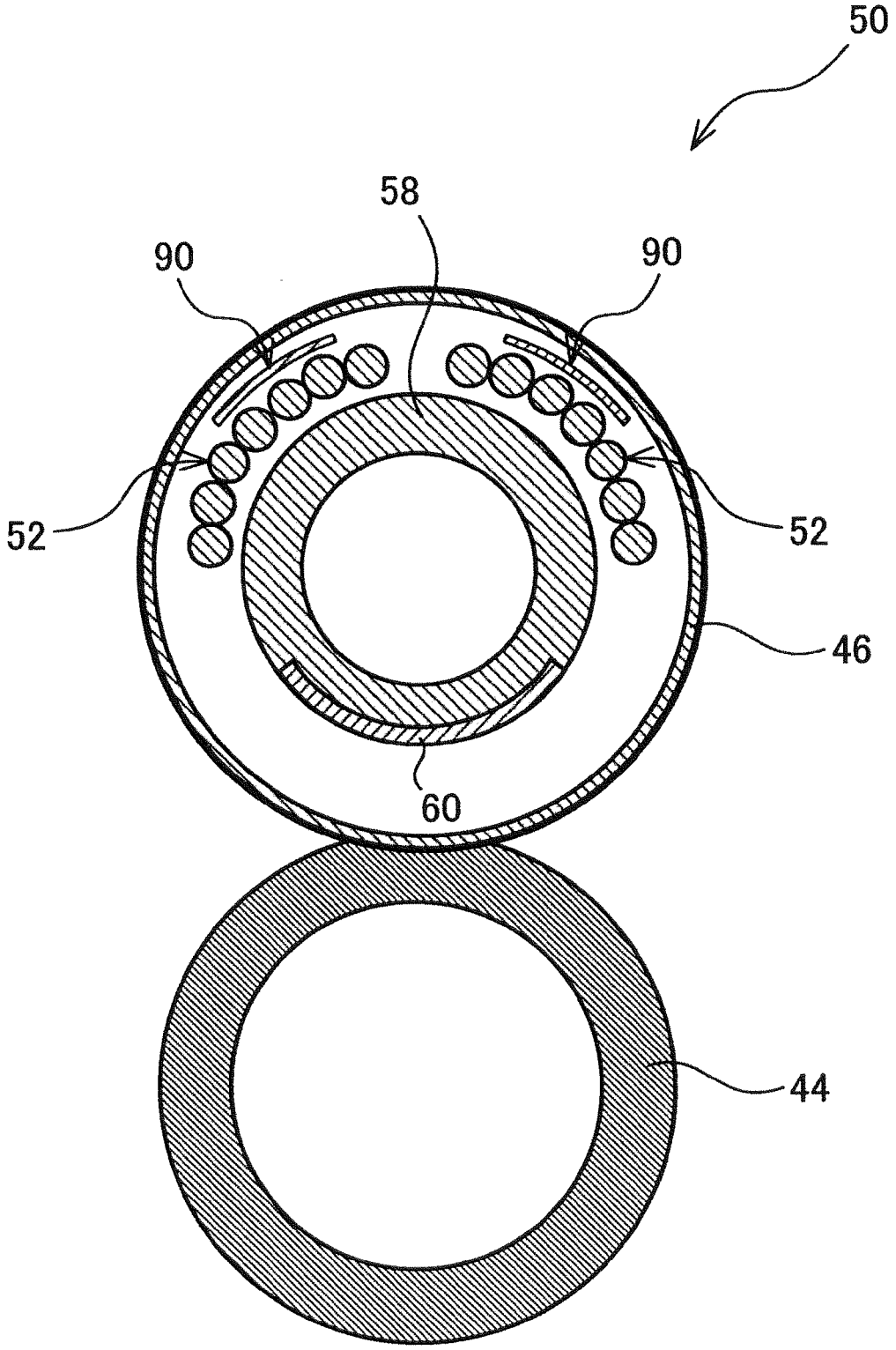
FIG. 18 is a diagram showing a fixing unit according to a fourth embodiment.

FIG. 18 is a vertical cross-sectional diagram showing a fixing unit 14 according to the fourth embodiment. The fixing unit 14 according to the fourth embodiment comprises an IH coil unit 50 of a so-called "internal wrap" type. The heating roller 46 may be made of a non-magnetic metal (for example, stainless steel) with a relatively larger diameter (for example, 40 mm). An induction heating coil 52 and a center core 58 are accommodated inside the heating roller 46. In contrast to the fixing units 14 of the first to third embodiments, arch cores 54 and side cores 56 are not provided on the outer side of the heating roller 46. A separating layer (PFA) may be formed on the surface of the heating roller 46. The pressurization roller 44 of the fixing unit 14 according to the fourth embodiment is similar to that of the fixing units according to the first to third embodiments.

In the "internal wrap" IH type of the fixing unit 14 shown in FIG. 18, the magnetic field generated by the induction heating coil 52 may be guided by the center core 58 inside the heating roller 46 to inductively heat the heating roller 46. In the fixing unit 14 according to the fourth embodiment, the movable shielding member 60 shown in FIG. 18 is in the retracted position where the movable shielding member 60 is the most distanced from the induction heating coil 52. The movable shielding member 60 in the retracted position causes no magnetism shielding effect, so that the region of the greatest paper passage width W3 of the heating belt 48 is inductively heated. On the other hand, when the movable shielding member 60 moves near the induction heating coil 52 (shielding position), then the magnetic path is switched to the second path, so that excessive temperature rise outside the paper passage region is suppressed.

As shown in the FIG. 18, the magnetism shielding members 90 according to the first structural example, for instance, may be applicable to the fixing unit 14 according to the fourth embodiment. The magnetism shielding members 90 according to the first structural example may be fixed between the induction heating coil 52 and the inner surface of the heating roller 46. Furthermore, the magnetism shielding members 90 according to the second to seventh structural examples may be also applicable to the fixing unit 14 according to the fourth embodiment.

Fixing Unit According to Fifth Embodiment

Figure 19:
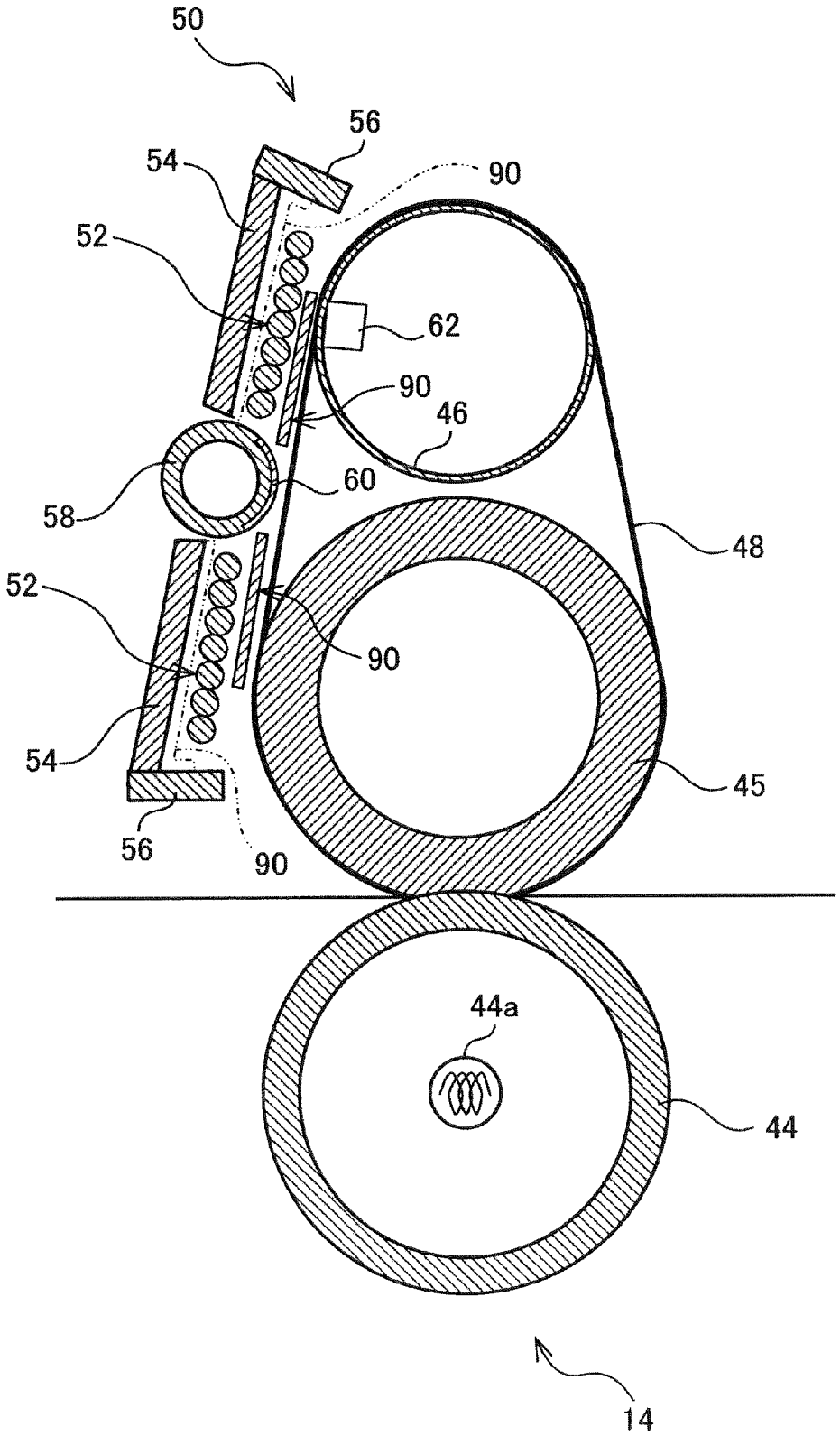
FIG. 19 is a diagram showing a fixing unit according to a fifth embodiment.

FIG. 19 shows a fixing unit 14 according to a fifth embodiment. The fixing unit 14 according to the fifth embodiment includes IH coil unit 50 facing the flat extension between the heating roller 46 and the fixing roller 45 rather than their arc portions, which is different from the first to fourth embodiments. In the fifth embodiment, the flat extension may be inductively heated. Similarly to the fixing units 14 relating to the first to fourth embodiments, the fixing unit 14 according to the fifth embodiment may switch the magnetic path by rotating the center core 58.

The magnetism shielding members 90 may be flat, rather than curved. For example, as indicated by the solid lines in FIG. 19, the magnetism shielding members 90 may have a structure similar to that of the first structural example, and may be disposed between the induction heating coil 52 and the heating belt 48. Alternatively, as indicated by the double-dotted line in FIG. 19, the magnetism shielding members 90 may be fixed along the inner surfaces of the arch cores 54 between the arch cores 54 and the induction heating coil 52. Furthermore, the magnetism shielding members 90 according to the second to seventh structural examples may be also applicable to the fixing unit 14 according to the fifth embodiment.

The present invention is not limited to these embodiments described above, and may be modified in various ways. For instance, the cross-sectional shape of the center core 58 is not limited to a round cylindrical or a round bar shape, and may also be a polygonal shape. Furthermore, the shape of the movable shielding member 60 in plan view is not limited to a triangular shape and may also be a trapezoid shape. Moreover, the movable shielding member 60 may also have a ring shape or loop shape.

Furthermore, the shape and size of the loops of the magnetism shielding members 90 described in the embodiment, and the number of divisions thereof, and so on, are no more than examples, and are not limited in particular to the embodiment.

In addition, the specific form of each part, including the arch cores 54 and the side cores 56, is not limited to what is shown, and can be modified as appropriate.

The various embodiments mainly includes following features.

One aspect of the above-mentioned embodiment provides a fixing unit for fixing a toner image onto paper, comprising: a member to be heated; a pressurizing member configured to press against the member to be heated and fix the toner image to the paper; at least one coil surface disposed along one surface of the member to be heated and including a coil configured to generate a magnetic field for inductively heating the member to be heated; at least one magnetism shielding member disposed in the vicinity of the at least one coil surface; and a switching member including a first member configured to allow a passage of a magnetic flux of the magnetic field and a second member configured to prevents the passage of the magnetic flux of the magnetic field, wherein the amount of heat for the member when the switching member is situated in a first position where the second member is close to the at least one magnetism shielding member is smaller than when the switching member is situated in a second position where the second member is distanced from the at least one magnetism shielding member. The fixing unit may fix the toner image onto paper between the member to be heated and the pressurizing member. The member may be inductively heated by the magnetic field from the coil surface. Although according to the above-mentioned embodiment the member to be heated includes the heating roller and/or the heating belt the member to be heated may be any member to be inductively heated. Although according to the above-mentioned embodiment the pressurizing member includes the pressurization roller, the pressurizing member may be any member capable of giving pressure-energy for toner fixation. The magnetic flux may pass the first member but not the second member of the switching member. The switching member may be the center core as the above-described embodiment in which the first member is a ferrite core and the second member is the movable shielding member, but the switching member as well as the first/second member is not limited to this.

When the second member is in the first position, the second member prevents a passage of a magnetic flux of the magnetic field to the member to be heated. When the second member is in the second position, the magnetic flux reaches the member to be heated via the first member. Therefore the amount of heat for the member to be heated when the switching member is situated in the first position is smaller than when the switching member is situated in the second position.

The fixing unit may further comprise at least one magnetic core configured to define a path of the magnetic flux of the magnetic field outside the member to be heated. Although according to the above-mentioned embodiment the magnetic core includes arch core and side core, the magnetic core is not limited to these. The magnetic core may be one magnetic core or other structured magnetic core to define a path of the magnetic flux of the magnetic field outside the member to be heated.

The at least one coil surface may be disposed between the at least one magnetic core and the member to be heated. The at least one magnetism shielding member may be disposed between the at least one coil surface and the member to be heated or between the at least one magnetic core and the at least one coil surface.

The at least one coil surface may include a pair of coil surfaces separated from each other. The at least one magnetic core may include a pair of cores separated from each other so as to correspond to the pair of coil surfaces. In this structure, the switching member may be positioned between the pair of cores.

The at least one magnetism shielding member may include a pair of magnetism shielding members. The at least one magnetic core may include a projecting section configured to project toward a gap between the pair of magnetism shielding members. The projecting section may be the intermediate core 55 as the above-described embodiment, but the projecting section may not be limited to this. In this structure, the switching member may be disposed inside the member to be heated.

The at least one magnetism shielding member may include a plurality of loops. In this structure, each of loops may be configured to generate a magnetic flux directed against a magnetic flux passing through the loop.

The fixing unit may further comprise a drive configured to rotate the cylindrical switching member. In this structure, the second member may at least partially cover the outer circumferential surface of the switching member. The coverage of the second member on the switching member may become greater toward the end of the switching member. The at least one magnetism shielding member may extend in a longitudinal direction of the switching member. The at least one magnetism shielding member may not exist at a central position in the longitudinal direction of the switching member. The at least one magnetism shielding member may include a plurality of loops aligned in a longitudinal direction of the switching member. In this structure, each of loops is configured to generate a magnetic flux directed against a magnetic flux passing through the loop.

The member to be heated may include a heating roller heated by the magnetic field from the coil and configured to extend in a longitudinal direction of the switching member. In this structure, the switching member is disposed inside the heating roller. In this structure, the fixing unit may further comprise at least one magnetic core configured to define a path of the magnetic field generated from the coil outside the heating roller wherein the at least one coil surface includes a pair of coil surfaces; the at least one magnetism shielding member includes a pair of magnetism shielding members, the pair of coil surfaces is disposed between the at least one magnetic core and the heating roller, the pair of magnetism shielding members is positioned between the pair of coil surfaces and the heating roller, and the at least one magnetic core includes a projecting section configured to project toward a gap between the pair of magnetism shielding members. In this structure, the at least one coil surface may be positioned between the magnetic core and the switching member, and the at least one magnetism shielding member may be disposed between the at least one coil surface and the heating roller. In this structure, the fixing unit may further comprise at least one magnetic core configured to define a path of the magnetic field generated from the coil outside the member to be heated, wherein the member to be heated includes a pair of rotating rollers and an endless belt wound around the pair of rotating rollers, the at least one coil surface is disposed along a flat outer surface of the endless belt between the pair of rotating rollers, the at least one magnetic core at least partially surrounds the at least one coil surface, and the at least one magnetism shielding member is disposed between the coil surface and the flat surface. The endless belt may be the heating belt 48 as the above-described embodiment, but the endless belt may not be limited to this.

The fixing unit may further comprise at least one magnetic core configured to define a path of the magnetic field generated from the coil outside the member to be heated, wherein the member to be heated includes a pair of rotating rollers and an endless belt wound around the pair of rotating rollers, the at least one coil surface is disposed along a flat outer surface of the endless belt between the pair of rotating rollers, the at least one magnetic core at least partially surrounds the at least one coil surface, and the at least one magnetism shielding member is disposed between the at least one coil surface and the at least one magnetic core.

Another aspect of the above-mentioned embodiment provides an image forming apparatus comprising the fixing unit above-described.

Yet another aspect of the above-mentioned embodiment provides a fixing unit for fixing a toner image onto paper, comprising: a member to be heated; a pressurizing member configured to press against the member to be heated and fix a toner image to paper; at least one coil surface disposed along an outer surface of the member to be heated and including a coil configured to generate a magnetic field for inductively heating the member; a magnetic core configured to at least partially surround the at least one coil surface; a first magnetism shielding surface disposed between the magnetic core and the member to be heated; and a rotatable switching member configured to extend in the width direction of the paper, wherein the switching member includes a magnetic body and a second magnetism shielding surface, and the second magnetism shielding surface lies adjacent to the first magnetism shielding surface by the rotation of the switching member, so that the second magnetism shielding surface at least partially surrounds the member to be heated together with the first magnetism shielding surface. The fixing unit may fix the toner image onto paper between the member to be heated and the pressurizing member. The member to be heated may be inductively heated by the magnetic field from the coil surface. The second magnetism shielding surface may change its position according to the rotation of the switching member. When the second magnetism shielding surface lies adjacent to the first magnetism shielding surface, the member to be heated may be at least partially surrounded with the magnetism shielding surfaces so that the magnetic field may not reach the member to be heated.

This application is based on Japanese patent application serial No. 2008-215215, filed in Japan Patent Office on Aug. 25, 2008, the content of which are hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing unit for fixing a toner image onto paper, comprising:

a member to be heated;

a pressurizing member configured to press against the member to be heated and fix the toner image to the paper;

at least one coil surface disposed along one surface of the member to be heated and including a coil configured to generate a magnetic field for inductively heating the member;

at least one magnetism shielding member disposed in the vicinity of the at least one coil surface; and a switching member including a rotatable center core configured to allow a passage of a magnetic flux of the magnetic field and a movable shielding member configured to prevent the passage of the magnetic flux of the magnetic field, wherein the movable shielding member is attached to the center core, the amount of heat for the member when the switching member is situated in a first position where the movable shielding member is close to the at least one magnetism shielding member is smaller than when the switching member is situated in a second position where the movable shielding member is distanced from the at least one magnetism shielding member, and the at least one magnetism shielding member is disposed between the at least one coil surface and the member to be heated.

2. The fixing unit according to claim 1, further comprising at least one magnetic core configured to define a path of the magnetic flux of the magnetic field outside the member to be heated.

3. The fixing unit according to claim 2, wherein the at least one coil surface is disposed between the at least one magnetic core and the member to be heated.

4. The fixing unit according to claim 3, wherein the at least one magnetism shielding member is disposed between the at least one coil surface and the member to be heated.

5. The fixing unit according to claim 3, wherein the at least one magnetism shielding member is disposed between the at least one magnetic core and the at least one coil surface.

6. The fixing unit according to claim 3, wherein the at least one coil surface includes a pair of coil surfaces separated from each other, the at least one magnetic core includes a pair of magnetic cores separated from each other so as to correspond to the pair of coil surfaces, and the switching member is positioned between the pair of cores.

7. The fixing unit according to claim 3, wherein the at least one magnetism shielding member includes a pair of magnetism shielding members, the at least one magnetic core includes a projecting section configured to project toward a gap between the pair of magnetism shielding members, and the switching member is disposed inside the member to be heated.

8. The fixing unit according to claim 1, wherein the at least one magnetism shielding member includes a plurality of loops, and each of loops is configured to generate a magnetic flux directed against a magnetic flux passing through the loop.

9. The fixing unit according to claim 1, further comprising a drive configured to rotate the switching member wherein the switching member is cylindrical, and the movable shielding member at least partially covers the outer circumferential surface of the switching member.

10. The fixing unit according to claim 9, wherein a coverage of the movable shielding member on the switching member becomes greater toward the end of the switching member.

11. The fixing unit according to claim 9, wherein the at least one magnetism shielding member extends in a longitudinal direction of the switching member.

12. The fixing unit according to claim 11, wherein the at least one magnetism shielding member does not exist at a central position in the longitudinal direction of the switching member.

13. The fixing unit according to claim 9, wherein the at least one magnetism shielding member includes a plurality of loops aligned in a longitudinal direction of the switching member, and each of loops is configured to generate a magnetic flux directed against a magnetic flux passing through the loop.

14. The fixing unit according to claim 9, wherein the member to be heated includes a heating roller heated by the magnetic field from the coil and configured to extend in a longitudinal direction of the switching member, and the switching member is disposed inside the heating roller.

15. The fixing unit according to claim 14, further comprising:

at least one magnetic core configured to define a path of the magnetic flux of the magnetic field generated from the coil outside the heating roller wherein the at least one coil surface includes a pair of coil surfaces;

the at least one magnetism shielding member includes a pair of magnetism shielding members, the pair of coil surfaces is disposed between the at least one magnetic core and the heating roller, the pair of magnetism shielding members is positioned between the pair of coil surfaces and the heating roller, and the at least one magnetic core includes a projecting section configured to project toward a gap between the pair of magnetism shielding members.

16. The fixing unit according to claim 14, wherein the at least one coil surface is positioned between the magnetic core and the switching member, and the at least one magnetism shielding member is disposed between the at least one coil surface and the heating roller.

17. The fixing unit according to claim 9, further comprising:

at least one magnetic core configured to define a path of the magnetic field generated from the coil outside the member to be heated, wherein the member to be heated includes a pair of rotating rollers and an endless belt wound around the pair of rotating rollers, the at least one coil surface is disposed along a flat outer surface of the endless belt between the pair of rotating rollers, the at least one magnetic core at least partially surrounds the at least one coil surface, and the at least one magnetism shielding member is disposed between the coil surface and the flat surface.

18. The fixing unit according to claim 9, further comprising:

at least one magnetic core configured to define a path of the magnetic flux of the magnetic field generated from the coil outside the member to be heated, wherein the member to be heated includes a pair of rotating rollers and an endless belt wound around the pair of rotating rollers, the at least one coil surface is disposed along a flat outer surface of the endless belt between the pair of rotating rollers, the at least one magnetic core at least partially surrounds the at least one coil surface, and the at least one magnetism shielding member is disposed between the at least one coil surface and the at least one magnetic core.

19. An image forming apparatus comprising the fixing unit according to claim 1.

20. A fixing unit for fixing a toner image onto paper, comprising:

a member to be heated;

a pressurizing member configured to press against the member to be heated and fix a toner image to paper;

at least one coil surface disposed along an outer surface of the member to be heated and including a coil configured to generate a magnetic field for inductively heating the member;

a magnetic core configured to at least partially surround the at least one coil surface;

a first magnetism shielding surface disposed between the magnetic core and the member to be heated; and a rotatable switching member configured to extend in the width direction of the paper, wherein the switching member includes a magnetic and rotatable center core and a second magnetism shielding surface attached to the center core and movable with the center core, and the second magnetism shielding surface lies adjacent to the first magnetism shielding surface by the rotation of the switching member, so that the second magnetism shielding surface at least partially surrounds the member to be heated together with the first magnetism shielding surface.

21. A fixing unit for fixing a toner image onto paper, comprising:

a member that is to be heated;

a pressurizing member configured to press against the member to be heated and fix the toner image to the paper;

at least one coil surface disposed along one surface of the member to be heated and including a coil configured to generate a magnetic field for inductively heating the member;

at least one magnetism shielding member disposed in the vicinity of the at least one coil surface; and a cylindrical switching member with an outer circumferential surface, the switching member including a center core configured to allow a passage of a magnetic flux of the magnetic field and a movable shielding member configured to prevent the passage of the magnetic flux of the magnetic field, the movable shielding member at least partly covering the outer circumferential surface of the switching member;

a drive configured to rotate the switching member, wherein the amount of heat for the member that is to be heated when the switching member is situated in a first position where the movable shielding member is close to the at least one magnetism shielding member is smaller than when the switching member is situated in a second position where the movable shielding member is distanced from the at least one magnetism shielding member, and the at least one magnetism shielding member includes a plurality of loops aligned in a longitudinal direction of the switching member, and each of the loops is configured to generate a magnetic flux directed against a magnetic flux passing through the loop.

* * * * *